US011466701B2

(12) United States Patent
Yamamoto et al.

(10) Patent No.: US 11,466,701 B2
(45) Date of Patent: Oct. 11, 2022

(54) VACUUM PUMP, AND STATOR COMPONENT, DISCHARGE PORT, AND CONTROL MEANS USED THEREIN

(71) Applicant: Edwards Japan Limited, Chiba (JP)

(72) Inventors: Kazushi Yamamoto, Chiba (JP); Manabu Nonaka, Chiba (JP); Yoshiyuki Sakaguchi, Chiba (JP); Takashi Kabasawa, Chiba (JP)

(73) Assignee: Edwards Japan Limited, Chiba (JP)

( * ) Notice: Subject to any disclaimer, the term of this patent is extended or adjusted under 35 U.S.C. 154(b) by 164 days.

(21) Appl. No.: 16/956,722

(22) PCT Filed: Dec. 25, 2018

(86) PCT No.: PCT/JP2018/047673
§ 371 (c)(1),
(2) Date: Jun. 22, 2020

(87) PCT Pub. No.: WO2019/131682
PCT Pub. Date: Jul. 4, 2019

(65) Prior Publication Data

US 2020/0332811 A1 Oct. 22, 2020

(30) Foreign Application Priority Data

Dec. 27, 2017 (JP) ..... JP2017-250428
Dec. 20, 2018 (JP) ..... JP2018-238342

(51) Int. Cl.
*F04D 29/70* (2006.01)
*F04D 19/04* (2006.01)
*F04D 27/00* (2006.01)

(52) U.S. Cl.
CPC ..... *F04D 29/701* (2013.01); *F04D 19/044* (2013.01); *F04D 27/001* (2013.01)

(58) Field of Classification Search
CPC .... F04D 19/042; F04D 19/044; F04D 27/001; F04D 27/008; F04D 29/701
See application file for complete search history.

(56) References Cited

U.S. PATENT DOCUMENTS 6,224,326 B1 5/2001 Puech
9,895,727 B2 * 2/2018 Nakamura ..... C23C 16/4412
2015/0267296 A1 * 9/2015 Nishida ..... H01L 21/0214 118/704

FOREIGN PATENT DOCUMENTS

JP H01216082 A 8/1989
JP 2005325792 A 11/2005
(Continued)

OTHER PUBLICATIONS

Obayashi, machine translation of JP 2005 325792, published Nov. 24, 2005 (Year: 2005).*
(Continued)

*Primary Examiner* — Richard A Edgar
*Assistant Examiner* — Jason G Davis
(74) *Attorney, Agent, or Firm* — Theodore M. Magee; Westman, Champlin & Koehler, P.A.

(57) ABSTRACT

To provide a vacuum pump suited for removal of a product deposited in a flow path of the vacuum pump, and a stator component, a discharge port, and control means that are used in the vacuum pump. A vacuum pump includes a flow path through which a gas is transferred from an inlet port toward an outlet port and removing means that removes a product deposited on an inner wall surface of the flow path. The removing means has injection holes with one ends opened at the inner wall surface of the flow path and injects the removing gas into the flow path through the injection holes.

25 Claims, 20 Drawing Sheets

(56) References Cited

FOREIGN PATENT DOCUMENTS

| | | | |
|---|---|---|---|
| JP | 2007270742 | A | 10/2007 |
| JP | 2015031153 | A | 2/2015 |
| JP | 2015148151 | A | 8/2015 |

OTHER PUBLICATIONS

Iguchi et al, machine translation of JP 2007 270742, published Oct. 18, 2007 (Year: 2007).*
Yano et al, machine translation of JP H01 216082, published Aug. 30, 1989 (Year: 1989).*
PCT International Search Report dated Mar. 26, 2019 for corresponding PCT Application No. PCT/JP2018/047673.
PCT International Written Opinion dated Mar. 26, 2019 for corresponding PCT Application No. PCT/JP2018/047673.
European Communication dated Aug. 12, 2021 for corresponding European application Serial No. 18897004.0, 9 pages.

* cited by examiner

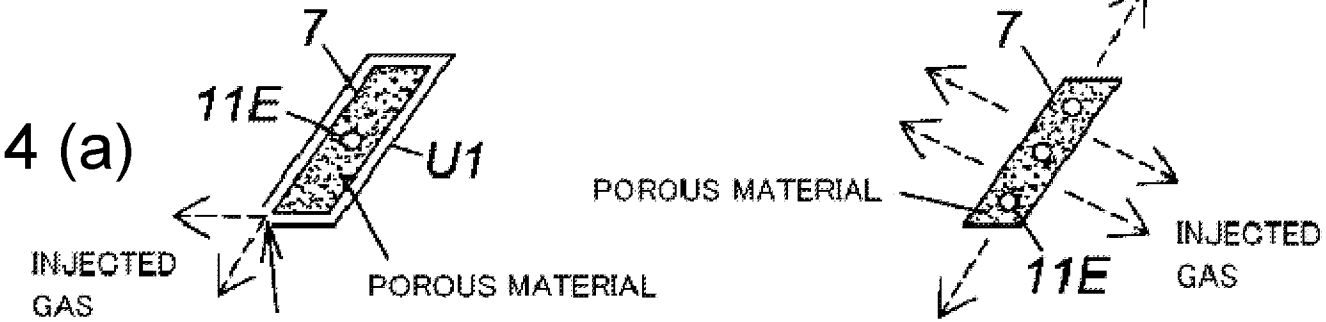
FIG. 14 (a)
FIG. 14 (b)
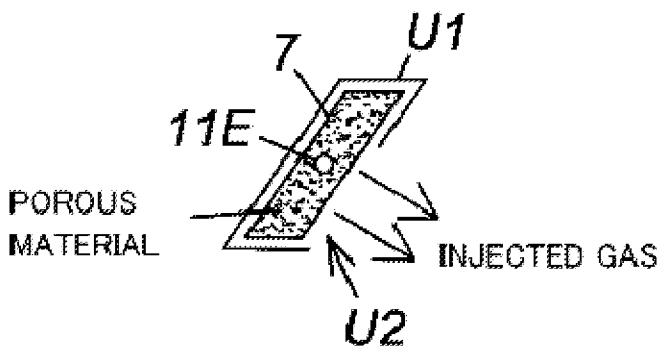
FIG. 14 (c)

VACUUM PUMP, AND STATOR COMPONENT, DISCHARGE PORT, AND CONTROL MEANS USED THEREIN

CROSS-REFERENCE OF RELATED APPLICATION

This application is a Section 371 National Stage Application of International Application No. PCT/JP2018/047673, filed Dec. 25, 2018, which is incorporated by reference in its entirety and published as WO 2019/131682 A1 on Jul. 4, 2019 and which claims priority of Japanese Application No. 2017-250428, filed Dec. 27, 2017 and Japanese Application No. 2018-238342, filed Dec. 20, 2018.

BACKGROUND

The present invention relates to a vacuum pump used as gas exhaust means for a process chamber of a semiconductor manufacturing process apparatus, a flat panel display manufacturing apparatus, a solar panel manufacturing apparatus, and other vacuum process chambers, as well as a stator component, a discharge port, and control means used in the vacuum pump and, more particularly, to such means suited for removal of a product deposited in a flow path in a pump.

in a semiconductor manufacturing process apparatus, a sublimation gas such as $TiF_4$ or $AlCl_3$ may be generated as reaction by-products during a process thereof. When such a sublimation gas is sucked by a vacuum pump and the sucked gas flows through a flow path in the vacuum pump, the sublimation gas is solidified and deposited on an inner wall surface of the flow path at a point at which the relationship between the pressure (partial pressure) and the temperature of the gas in the flow path, which is represented by a vapor pressure curve, shifts from a gaseous phase to a solid phase. Significant deposition occurs particularly at a point where the pressure is relatively high, such as vicinity of a downstream portion of the flow path.

In order to remove the product deposited as described above, heating and thermally insulating means such as a band heater is conventionally used to heat and thermally insulate a vacuum pump (see, for example, Japanese Patent Application Publication No. 2015-31153 or Japanese Patent Application Publication No. 2015-148151).

However, in a conventional method that heats and thermally insulates a vacuum pump as described above, structural components of the vacuum pump such as a rotating body are also heated and kept warm. Since particularly a rotating body of a vacuum pump rotates at high speed, if the rotating body continues to rotate with the designed allowable temperature of the material of the rotating body exceeded by heating and thermal insulation, the rotating body is broken by reduction in the strength of the material thereof, the rotating body is deformed by the creep strain of the rotating body, the deformed rotating body makes contact with a stator component located on the outer periphery thereof, and the rotating body and the stator component are broken due to the contact. Accordingly, the conventional method that heats and thermally insulates a vacuum pump is not suited for the removal of the product deposited in the flow path of the vacuum pump.

In addition, a gas with difficulty in removal of a deposited product, such as a gas with a high sublimation temperature, may flow through the flow path in the vacuum pump. In this case, since the product continues to be deposited in the gas flow path formed between the rotating body of the vacuum pump and a stator component located on the outer periphery thereof, the rotating body makes contact with the stator component via the deposited product, thereby breaking the rotating body or the stator component.

The discussion above is merely provided for general background information and is not intended to be used as an aid in determining the scope of the claimed subject matter. The claimed subject matter is not limited to implementations that solve any or all disadvantages noted in the background.

SUMMARY

The present invention addresses the above problems with an object of providing a vacuum pump suited for removal of a product deposited in a flow path in the vacuum pump, as well as a stator component, a discharge port, and control means that are used in the vacuum pump.

To achieve the object, the present invention includes a rotating body disposed in a casing; supporting means rotatably supporting the rotating body; driving means configured to rotationally drive the rotating body; an inlet port configured to suck a gas by rotation of the rotating body; an outlet port configured to exhaust the gas sucked through the inlet port; a flow path through which the gas is transferred from the inlet port toward the outlet port; and removing means configured to remove a product deposited on an inner wall surface of the flow path, in which the removing means has an injection hole with one end opened at the inner wall surface of the flow path and a removing gas is injected into the flow path through the injection hole.

The present invention may further include control means configured to function as means for performing control of any of a pressure, a flowrate, or an injection time of the removing gas.

In the present invention, detection means that detects a supply situation by a gas supply system that supplies the removing gas to the injection hole may be provided at a midpoint of the gas supply system.

In the present invention, the control means may function as means for outputting a signal required to adjust a supply pressure or a supply flowrate of the removing gas with respect to the injection hole based on a detection result by the detection means.

In the present invention, the control means may function as means for estimating a deposition amount of a product based on a detection result by the detection means and, when the estimated deposition amount exceeds a threshold, outputting a signal required to adjust a supply pressure or a supply flowrate of the removing gas with respect to the injection hole or outputting a signal required to sound an alert.

In the present invention, the control means may function as means for supplying the removing gas to the injection hole based on an instruction from an external device.

In the present invention, the control of the injection time may include at least either one of control that constantly injects the removing gas through the injection hole and control that intermittently injects the removing gas through the injection hole.

In the present invention, the control of the flowrate may include at least either one of control that keeps the flowrate of the removing gas injected through the injection hole constant and control that increases or reduces the flowrate.

In the present invention, the control of the pressure may include at least either one of control that keeps the pressure of the removing gas injected through the injection hole constant and control that supplies, to the injection hole in a projecting manner, the removing gas injected through the injection hole.

In the present invention, the removing gas may be an inert gas.

In the present invention, the removing gas may be a high-energy gas activated by exciting means.

In the present invention, the removing gas may be a high-temperature gas heated by heating means.

In the present invention, a plurality of injection holes, each of the plurality of injection holes being the injection hole, may be provided.

In the present invention, the inner wall surface of the flow path may be made of a porous material and holes of the porous material may be adopted as the injection hole.

In the present invention, by masking a part of a surface of the porous material constituting the inner wall surface of the flow path and configuring a portion other than the part of the surface as a non-masked portion that is not masked, the removing gas may be injectable into the flow path through the holes of the porous material within a range of the non-masked portion.

In the present invention, a plate body having a surface area larger than an opening area of an opening end of the injection hole may be provided near the opening end and the plate body may be made of a porous material and holes of the porous material may be adopted as the injection hole.

In the present invention, the flow path may be shaped like a thread groove formed between an outer periphery of the rotating body and a stator member opposed to the outer periphery and the flow path and one end of the injection hole may be opened in a portion of the inner wall surface of the flow path close to a downstream exit of the flow path.

In the present invention, the flow path may be shaped like a thread groove formed between an outer periphery of the rotating body and a stator member facing the outer periphery and the flow path and one end of the injection hole may be opened in a portion of the inner wall surface of the flow path close to an upstream entrance of the flow path.

in the present invention, the flow path may include a clearance set between a rotor blade provided on an outer peripheral surface of the rotating body and a stator blade positioned and fixed in the casing and one end of the injection hole may be opened in the portion of the inner wall surface of the flow path close to a downstream exit of the flow path.

In the present invention, the flow path may include a discharge port communicating with a downstream exit of the flow path and one end of the injection hole may be opened at the inner wall surface of the discharge port.

In the present invention, the flow path may include a clearance set between a rotor blade provided on an outer peripheral surface of the rotating body and a stator blade positioned and fixed in the casing, and the flow path may include an inner surface of a spacer that positions and fixes the stator blade and one end of the injection hole may be opened in an inner wall surface of the spacer.

In the present invention, the flow path may include a clearance set between a rotor blade provided on an outer peripheral surface of the rotating body and a stator blade positioned and fixed in the casing and one end of the injection hole may be opened in an outer surface of the stator blade.

In the present invention, the supply based on the instruction may include processing that outputs a maintenance request signal to the external device and processing that outputs a signal required for the supply of the removing gas to the injection hole when a maintenance permission signal output from the external device in response to the maintenance request signal is received.

In the present invention, the inner wall surface of the flow path may be coated with a material having higher non-adhesiveness or lower surface free energy than a structural base material of the flow path.

In the present invention, the material with which the inner wall surface of the flow path is coated may be fluororesin or a coating material including fluororesin.

The present invention is a stator component included in a flow path of a vacuum pump, the stator component including a rotating body disposed in a casing; supporting means rotatably supporting the rotating body; driving means configured to rotationally drive the rotating body; an inlet port configured to suck a gas by rotation of the rotating body; art outlet port configured to exhaust the gas sucked through the inlet port; and a flow path through which the gas is transferred from the inlet port toward the outlet port, in which an injection hole with one end opened in art inner wall surface of the stator component is provided as removing means for removing a product deposited on an inner wall surface of the flow path.

The present invention is an discharge port included in the outlet port of a vacuum pump, the outlet port including a rotating body disposed in a casing; supporting means rotatably supporting the rotating body; driving means configured to rotationally drive the rotating body; an inlet port configured to suck a gas by rotation of the rotating body; an outlet port configured to exhaust the gas sucked through the inlet port; and a flow path through which the gas is transferred from the inlet port toward the outlet port, in which an injection hole with one end opened in art inner wall surface of the stator component is provided as removing means for removing a product deposited on an inner wall surface of the discharge port.

The present invention is control means of a vacuum pump, the control means including a rotating body disposed in a casing; supporting means rotatably supporting the rotating body; driving means configured to rotationally drive the rotating body; an inlet port configured to suck a gas by rotation of the rotating body; an outlet port configured to exhaust the gas sucked through the inlet port; a flow path through which the gas is transferred from the inlet port toward the outlet port; and removing means configured to remove a product deposited on an inner wall surface of the flow path, the removing means having an injection hole with one end opened at the inner wall surface of the flow path and injecting a removing gas into the flow path through the injection hole, in which the control means controls one of a pressure, a flowrate, and an injection time of the removing gas injected into the flow path through the injection hole is controlled, outputs a signal required to adjust a supply pressure or a supply flowrate of the removing gas, functions as means for outputting a signal required to sound an alert, or functions as means for supplying the removing gas to the injection hole based on an instruction from an external device.

in the present invention, as a specific structure of the removing means for removing the product on the inner wall surface of the flow path, the removing means adopts a structure that has an injection hole with one end opened at the inner wall surface of the flow path and injects the removing gas into the flow path through the injection hole, as described above. Accordingly, the product deposited on the inner wall surface of the flow path is forcibly peeled off and removed by a physical force of the removing gas injected through the injection hole, not by heating and thermally insulating the pump as conventional. Therefore, conventional failures due to heating and thermal insulation of the pump (such as, breakage due to reduction in the material strength of the rotating body, deformation due to creep strain of the rotating body, contact between the deformed rotating body and the stator component located on the outer periphery thereof, or breakage of the rotating body or the stator component due to the contact) do not occur, so it is possible to provide a vacuum pump suited for removal of the product deposited in the flow path of the vacuum pump, as well as a stator component, an discharge port, and control means used in the vacuum pump.

In the present invention, "holes of a porous material are adopted as injection holes" includes "a part of the holes of a porous material is adopted as injection holes" and "all of the holes of a porous material are adopted as an injection hole". This is also true of DESCRIPTION OF THE PREFERRED EMBODIMENTS.

In the present invention, "a removing gas can be into the flow path through holes of a porous material" includes "a removing gas can be injected into the flow path through a part of the holes of a porous material" and "a removing gas can be injected into the flow path through all of the holes of a porous material". This is also true of DESCRIPTION OF THE PREFERRED EMBODIMENTS.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

FIG. 3A is a plan view illustrating a spacer to which Structure Example 4 is applied, FIG. 3B is a side view in which a half range in a radial direction of the spacer is cut off, and FIG. 3C is an enlarged view illustrating vicinity of a fourth injection hole illustrated in FIG. 3B;

FIG. 4A is a plan view (broken state before assembly to the vacuum pump) illustrating a plurality of stator blades to which the structure is applied, FIG. 4B is an enlarged view illustrating portion A in FIG. 4A, FIG. 4C is a sectional view seen along arrows D1 in FIG. 4B, FIG. 4D is a sectional view seen along arrows D2 in FIG. 4B, and FIG. 4E is a structural diagram illustrating an example of combination of the structure example of the removing means in FIGS. 4A to 4E and the structure example of the removing means in FIGS. 3A to 3C;

FIG. 14A and FIG. 14B are explanatory diagrams illustrating examples of forming a fifth injection hole using holes of a porous material in a structure in which the fifth injection hole is provided in the stator blade and FIG. 14*c* is an explanatory diagram illustrating an example omitting masking in a structure in which the stator blade is formed by a porous material;

DETAILED DESCRIPTION

A preferred embodiment of the present invention will be described in detail below with reference to the attached drawings.

Figure 1:
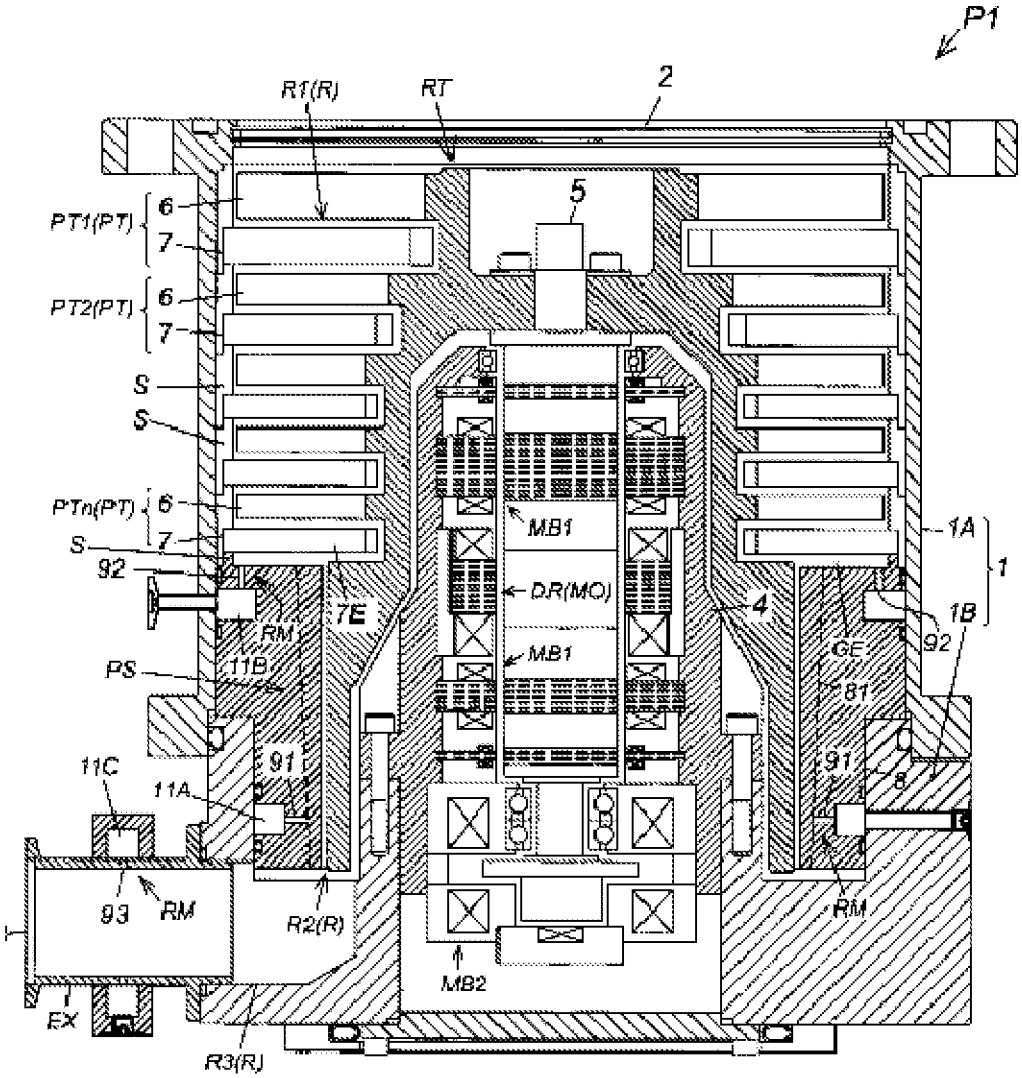
FIG. 1 is a sectional view illustrating a vacuum pump to which the present invention is applied (including specific examples 1 and 2 of removing means)
Figure 2:
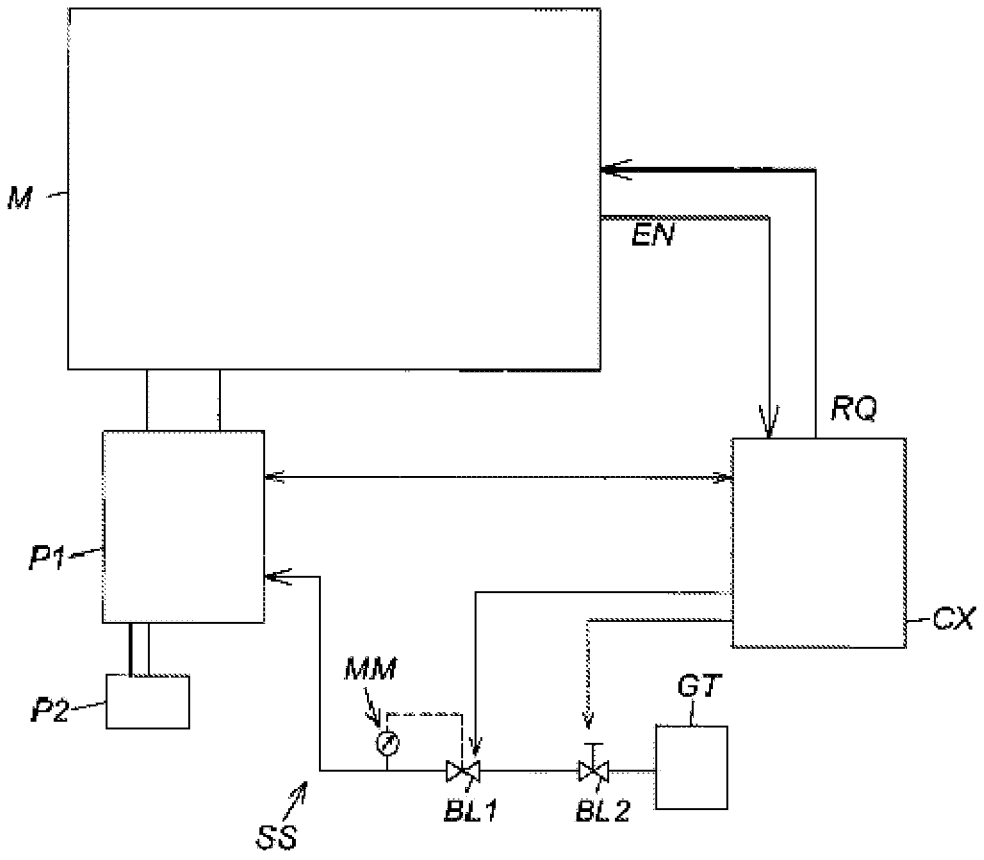
FIG. 2 is a schematic structural diagram illustrating an exhaust system including the vacuum pump in FIG. 1 and an external device that adopts the vacuum pump as gas exhaust means.

FIG. 1 is a sectional view illustrating a vacuum pump to which the present invention is applied and FIG. 2 is a schematic structural diagram illustrating an exhaust system including an external device that adopts the vacuum pump in FIG. 1 as gas exhaust means.

Referring to FIG. 1, a vacuum pump P1 in FIG. 1 includes a casing 1 with a cylindrical cross section, a rotating body RT disposed in the casing 1, supporting means SP rotatably supporting the rotating body RT, driving means DR for rotationally driving the rotating body RT, an inlet port 2 through which a gas is sucked by rotation of the rotating body RT, an outlet port 3 through which the gas sucked through the inlet port 2 is exhausted, a flow path R through which the gas is transferred from the inlet port 2 toward the outlet port 3, and removing means RM for removing a product deposited on the inner wall surface of the flow path R.

The casing 1 has a bottomed cylindrical shape formed by integrally joining a cylindrical pump case 1A to a bottomed cylindrical pump base 1B in a cylinder axis direction thereof with a tightening bolt and an upper end portion of the pump case 1A is opened as the inlet port 2.

in addition, an discharge port EX is provided in a side surface of a lower end portion of the pump base 1B and one end of the discharge port EX communicates with the flow path R and another end of the discharge port EX is opened as the outlet port 3.

Referring to FIG. 2, the inlet port 2 is connected to a device M (referred to below as an external device M) that performs a predetermined process in a vacuum atmosphere, which is a vacuum chamber that becomes a high vacuum, such as, for example, a process chamber of semiconductor manufacturing equipment. The outlet port 3 is communicatively connected to an auxiliary pump P2.

As illustrated in FIG. 1, the center portion of the pump case 1A is provided with a cylindrical a stator column 4 containing various electrical components. Although the stator column 4 is vertically provided on the inner bottom of the pump base 1B by forming the stator column 4 as a separate component from the pump base 1B and fixing the stator column 4 to the inner bottom of the pump base 1B with screws in the vacuum pump P1 in FIG. 1, the stator column 4 may be vertically provided integrally on the inner bottom of the pump base 1B in another embodiment.

[The rotating body RT described above is provided outside the stator column 4. The rotating body RT is contained in the pump case 1A and the pump base 1B and has a cylindrical shape surrounding the outer periphery of the stator column 4.

A rotating shaft 5 is provided inside the stator column 4. The rotating shaft 5 is disposed so that an upper end portion thereof faces the inlet port 2 and a lower end portion thereof faces the pump base 1B. In addition, the rotating shaft 5 is rotatably supported by magnetic bearings (specifically, two sets of known radial magnetic bearings MB1 and one set of known axial magnetic bearings MB2). In addition, a driving motor MO is provided inside the stator column 4 and the rotating shaft 5 is rotationally driven about the shaft center by this driving motor MO.

The upper end portion of the rotating shaft 5 projects upward from the upper end surface of the cylinder of the stator column 4 and the upper end side of the rotating body RT is integrally fixed to the projecting upper end portion of the rotating shaft 5 by fastening means such as a bolt. That is, the rotating body RT is rotatably supported by the magnetic bearings (radial magnetic bearings MB1 and axial magnetic bearings MB2) via the rotating shaft 5 and, when the driving motor MO is started in this support state, the rotating body RT can rotate about the shaft center thereof integrally with the rotating shaft 5. That is, in the vacuum pump P1 in FIG. 1, the rotating shaft 5 and the magnetic bearing function as supporting means rotatably supporting the rotating body RT and the driving motor MO functions as driving means for rotationally driving the rotating body RT.

In addition, the vacuum pump P1 in FIG. 1 has a plurality of blade exhaust stages PT that function as means for exhausting gas molecule between the inlet port 2 and the outlet port 3.

In addition, in the vacuum pump P1 in FIG. 1, a thread groove pump stage PS is provided downstream of the plurality of blade exhaust stages PT (specifically, between the lowest blade exhaust stage (PTn) of the plurality of blade exhaust stages PT and the outlet port 3).

Details of the Blade Exhaust Stages PT

A portion of the vacuum pump P1 in FIG. 1 upward of substantially the middle of the rotating body RT functions as the plurality of blade exhaust stages PT. The plurality of blade exhaust stages PT will be described in detail below.

A plurality of rotor blades 6 that rotate together with the rotating body RT are provided on an outer peripheral surface of the rotating body RT upstream of substantially the middle of the rotating body RT and these rotor blades 6 are disposed radially at predetermined intervals about the rotating center axis (specifically, the shaft center of the rotating shaft 5) of the rotating body RT or the shaft center (referred to below as the vacuum pump shaft center) of the casing 1 for each of the blade exhaust stages PT (PT1, PT2, . . . PTn).

On the other hand, a plurality of stator blades 7 are positioned and fixed in the casing 1 (specifically, the inner peripheral side of the pump case 1A) and these stator blades 7 are also disposed radially at predetermined intervals about the vacuum pump shaft center for each of the blade exhaust stages PT (PT1, PT2, . . . PTn) as the rotor blades 6.

That is, the blade exhaust stages PT (PT1, PT2, . . . PTn) are provided in multiple stages between the inlet port 2 and the outlet port 3, and the plurality of rotor blades 6 and the plurality of stator blades 7 radially disposed at predetermined intervals are provided for each of the blade exhaust stages PT (PT1, PT2, . . . PTn) and gas molecules are exhausted by the rotor blades 6 and the stator blades 7.

Any of the rotor blades 6 is a blade-shaped cut product formed by cutting integrally with the outer diameter machined portion of the rotating body RT and inclined at an angle appropriate for exhausting gas molecules. Any of the stator blades 7 is also inclined at an angle appropriate for exhausting gas molecules.

In addition, although the vacuum pump P1 in FIG. 1 adopts a structure in which the plurality of stator blades 7 are positioned and fixed by adopting, as a specific structure of a thread groove exhaust portion stator 8, a component (threaded spacer) with an upper end portion at which a spacer S projects and inserting the outer peripheral portions of the stator blades 7 between the plurality of spacers S in a state in which the plurality of spacers S are further stacked in multiple stages along a direction from this threaded spacer to the pump shaft center. However, the positioning and fixing of the stator blades 7 by the spacers S is not limited to this structure.

Description of Exhaust Operation in the Plurality of Blade Exhaust Stages PT

In the highest blade exhaust stage PT (PT1) of the plurality of blade exhaust stages PT having the above structure, the plurality of rotor blades 6 rotate at high speed integrally with the rotating shaft 5 and the rotating body RT when the driving motor MO is started, and gas molecules input through the inlet port 2 are given kinetic momentum in the downward direction and the tangential direction by inclined planes of the rotor blades 6 on the front surface in the rotational direction and the downward direction (direction from the inlet port 2 to the outlet port 3, which abbreviated below as the downward direction). Such gas molecules having the kinetic momentum in the downward direction are sent to the next blade exhaust stage PT (PT2) by a downward inclined planes, provided on the stator blades 7, that have a rotational direction opposite to that of the rotor blades 6.

Also in the next blade exhaust stage PT (PT2) and subsequent blade exhaust stages PT, the rotor blades 6 rotate and the rotor blades 6 give kinetic momentum to gas molecules and the stator blades 7 send gas molecules as in the highest blade exhaust stage PT (PT1), so gas molecules near the inlet port 2 are transferred sequentially toward the downstream side of the rotating body RT and exhausted.

As is clear from exhaust operation of gas molecules in the plurality of blade exhaust stages PT described above, in the plurality of blade exhaust stages PT, the clearances set between the rotor blades 6 and the stator blades 7 are flow paths (referred to below as inter-blade exhaust flow paths R1) through which the gas is exhausted. This inter-blade exhaust flow paths R1 include, as an inner wall surface structure thereof, outer surfaces of the rotor blades 6 and the stator blades 7, and inner surfaces (surfaces opposed to the outer periphery of the rotating body RT) of the spacers S that position and fix the stator blades 7.

Details on the Thread Groove Pump Stage PS

A portion of the vacuum pump P1 in FIG. 1 downstream of substantially the middle of the rotating body RT functions as the thread groove pump stage PS. The thread groove pump stage PS will be described in detail below.

The thread groove pump stage PS has the thread groove exhaust portion stator 8 as means for forming a thread groove exhaust flow path R2 on the outer peripheral side (specifically, the outer peripheral side of the rotating body RT downstream of substantially the middle of the rotating body RT) of the rotating body RT and this thread groove exhaust portion stator 8 is attached to the inner peripheral side of the casing 1 as the stator component of the vacuum pump.

The thread groove exhaust portion stator 8 is a cylindrical stator member with an inner peripheral surface disposed so as to be opposed to the outer peripheral surface of the rotating body RT and disposed so as to surround the portion of the rotating body RT downstream of substantially the middle of the rotating body RT.

In addition, the portion of the rotating body RT downstream of substantially the middle of the rotating body RT rotates as a rotating component of a thread groove pump stage PS and is inserted and housed inside the thread groove exhaust portion stator 8 via a predetermined gap.

A thread groove 81 having a depth that changes like a tapered cone whose diameter is reduced toward a lower portion is formed in the inner peripheral portion of the thread groove exhaust portion stator 8. This thread groove 81 is carved spirally from the upper end to the lower end of the thread groove exhaust portion stator 8.

The thread groove exhaust portion stator 8 having the thread groove 81 described above forms the thread groove exhaust flow path R2 through which the gas is exhausted, on the outer peripheral side of the rotating body RT. Although not illustrated, the thread groove exhaust flow path R2 described above may be provided by forming the thread groove 81 described above in the outer peripheral surface of the rotating body RT.

Since the gas is transferred while being compressed by drag effects of the thread groove 81 and the outer peripheral surface of the rotating body RT in the thread groove pump stage PS, the depth of the thread groove 81 is deepest in the upstream entrance side (flow path opening end closer to the inlet port 2) of the thread groove exhaust flow path R2 and shallowest in the downstream exit side (flow path opening end closer to the outlet port 3).

The entrance (upstream opening end) of the thread groove exhaust flow path R2 is opened toward the exit, which is specifically a clearance (referred to below as a final clearance GE) between the stator blades 7E constituting the lowest blade exhaust stage PTn and the thread groove exhaust portion stator 8, of the inter-blade exhaust flow path R1 described above, and the exit (downstream opening end) of the thread groove exhaust flow path R2 communicates with the outlet port 3 through an in-pump outlet port side flow path R3.

The in-pump outlet port side flow path R3 communicates with the outlet port 3 from the exit of the thread groove exhaust flow path R2 by providing a predetermined clearance (clearance around the outer periphery of the lower portion of the stator column 4 in the vacuum pump P1 in FIG. 1) between the lower end portion of the rotating body RT or the thread groove exhaust portion stator 8 and the inner bottom portion of the pump base 1B.

Description of Exhaust Operation in the Thread Groove Pump Stage PS

The gas molecules that have reached the final clearance GE (exit of the inter-blade exhaust flow path R1) via transfer by exhaust operation at the plurality of blade exhaust stages PT are transferred to the thread groove exhaust flow path R2. The transferred gas molecules are transferred toward the in-pump outlet port side flow path R3 while being compressed from a transition flow to a viscous flow by drag effects caused by the rotation of the rotating body RT. Then, the gas molecules having reached the in-pump outlet port side flow path R3 flows into the outlet port 3 and is exhausted outside the casing 1 through an auxiliary pump (not illustrated).

Description of the Gas Flow Path R

As is clear from the description above, the vacuum pump P1 in FIG. 1 has the gas flow path R including the inter-blade exhaust flow path R1, the final clearance GE, the thread groove exhaust flow path R2, and the in-pump outlet port side flow path R3 and the gas is transferred from the inlet port 2 toward the outlet port 3 through this flow path R.

In the vacuum pump P1 in FIG. 1, the inner wall surface (specifically, the inner wall surface of the thread groove exhaust flow path R2) of the flow path R is coated with a material having higher non-adhesiveness or lower surface free energy than a structural base material of the flow path R.

Accordingly, even when a product is deposited on the inner wall surface of the flow path R, the deposited product is removed relatively easily. It should be noted here that the coating material may be fluororesin or a material including fluororesin, but the coating material is not limited to these materials.

Description of the Removing Means RM

In the vacuum pump P1 in FIG. 1, the removing means RM has injection holes 91, 92, and 93 with one ends opened at the inner wall surface of the flow path R and injects the removing gas into the flow path R through the injection holes 91, 92, and 93.

SPECIFIC STRUCTURE EXAMPLE 1 OF THE REMOVING MEANS RM

In the vacuum pump P1 in FIG. 1, one end of the first injection hole 91 is opened in a portion of the inner wall surface (excluding the inner wall surface of the discharge port EX described later) of the flow path close to the downstream exit of the flow path (that is, the thread groove exhaust flow path R2) shaped like a thread groove formed between the outer periphery of the rotating body RT and the thread groove exhaust portion stator S (stator component) opposed to this outer periphery.

Since the pressure is relatively high and the state of the gas flowing shifts from a gaseous phase to a solid phase near the downstream exit of the thread groove exhaust flow path R2, a product is likely to be deposited. However, the deposited product is forcibly peeled off and removed by a physical force of the removing gas injected through the first injection hole 91.

SPECIFIC STRUCTURE EXAMPLE 2 OF THE REMOVING MEANS RM

In the vacuum pump P1 in FIG. 1, one end of the second injection hole 92 is opened in a portion of the inner wall surface of the thread groove exhaust flow path R2 close to the upstream entrance of the thread groove exhaust flow path R2.

The upstream entrance of the thread groove exhaust flow path R2 is opened to the final clearance GE as described above, this final clearance GE intersects with the inter-blade exhaust flow path R1, and a flow of gas molecules to be exhausted significantly changes near the final clearance GE and the upstream entrance of the thread groove exhaust flow path R2. Accordingly, it is found from the experimental results by the inventors et al. that a region (referred to below as an exhaust gas stagnation region) in which the flowrate of the gas to be exhaust is reduced is easily generated and a product is easily deposited in such an exhaust gas stagnation region.

The product deposited in the exhaust gas stagnation region described above is forcibly peeled off and removed by a physical force of the removing gas injected through the second injection hole 92.

SPECIFIC STRUCTURE EXAMPLE 3 OF THE REMOVING MEANS RM

The flow path R in the vacuum pump P1 in FIG. 1 includes the discharge port EX that communicates with the downstream exit of the flow path R and one end of a third injection hole 93 is opened at the inner wall surface of the discharge port EX in the vacuum pump P1 in FIG. 1.

Since the discharge port EX is located downstream of the vicinity of the downstream exit of the thread groove exhaust flow path R2, the pressure is higher and a product is deposited easily. However, the deposited product is forcibly peeled off and removed by a physical force of the removing gas injected through the third injection hole 93.

SPECIFIC STRUCTURE EXAMPLE 4 OF THE REMOVING MEANS RM

Figure 3:
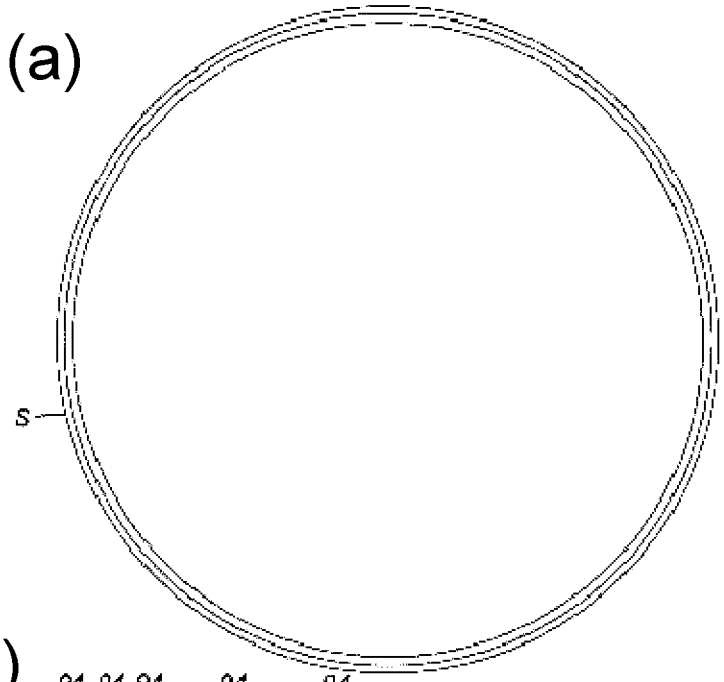
FIGS. 3A to 3C are explanatory diagrams illustrating Specific Structure Example 4 of the removing means.
Figure 3:
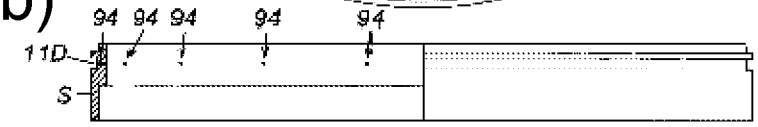
Figure 3:
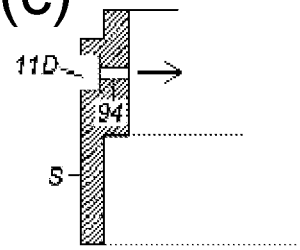

FIGS. 3A to 3C are explanatory diagrams illustrating Specific Structure Example 4 of the removing means RM, FIG. 3A is a plan view illustrating a spacer to which Structure Example 4 is applied, FIG. 3B is a side view in which a half range in a radial direction of the spacer is cut off, and FIG. 3C is an enlarged view illustrating the vicinity of the fourth injection hole 4 illustrated in FIG. 3B.

In Structure Example 4 in FIGS. 3A to 3C, the spacer S (see FIG. 1) is provided with a fourth injection hole 94 and one end of the fourth injection hole 94 is opened at the inner surface (specifically, the surface opposed to the outer peripheral surface of the rotating body RT) of the spacer S. It should be noted here that Structure Example 4 in FIGS. 3A to 3C also adopts a structure in which a removing gas supply path 11D is provided near the fourth injection hole 94 and a structure in which another end of the fourth injection hole 94 is opened to the removing gas supply path 11D.

SPECIFIC STRUCTURE EXAMPLE 5 OF THE REMOVING MEANS RM

Figure 4:
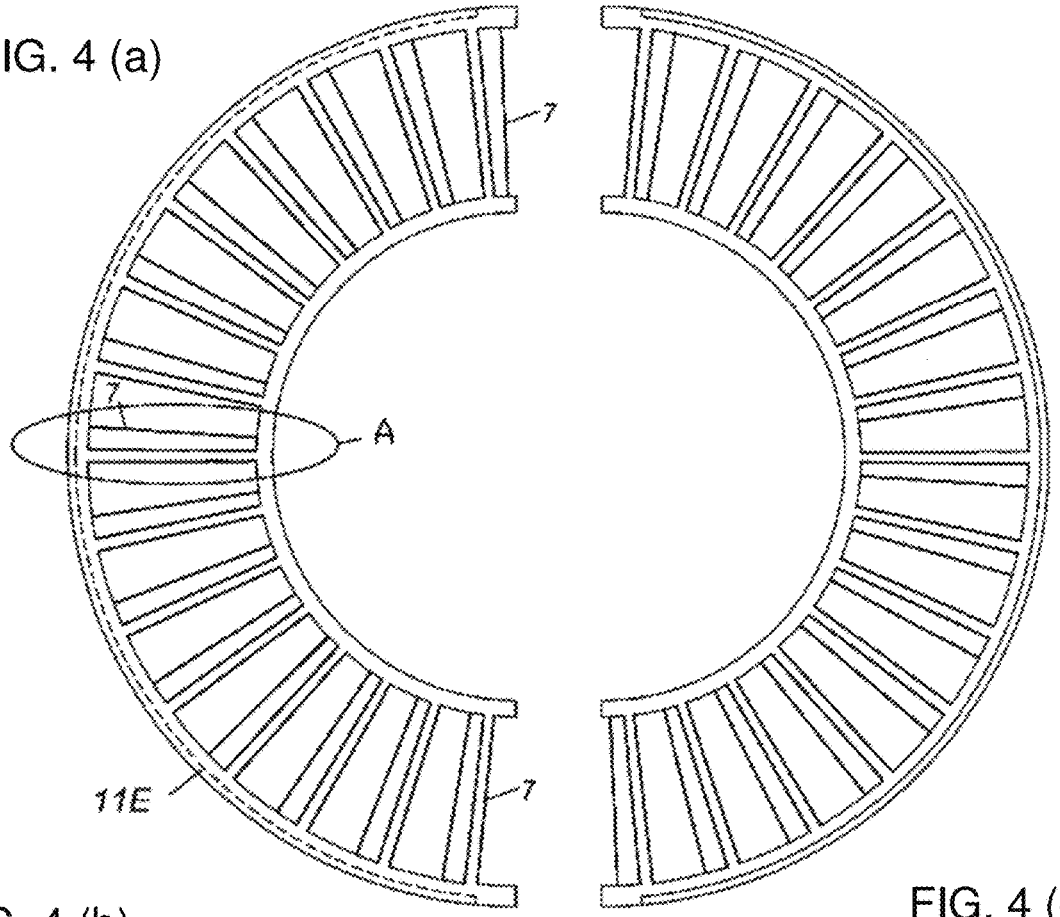
FIGS. 4A to 4E are explanatory diagrams illustrating Specific Structure Example 5 of the removing means.
Figure 4:
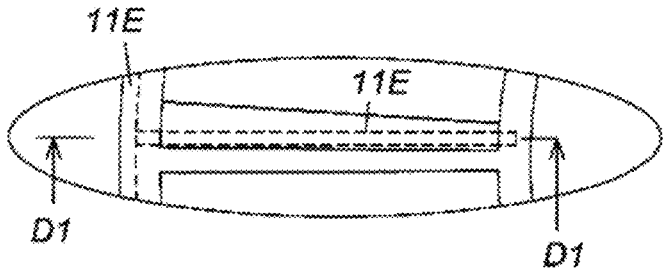
Figure 4:
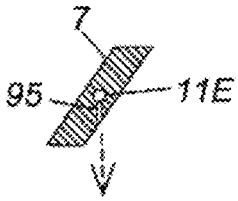
Figure 4:
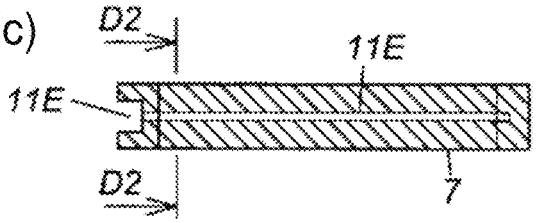
Figure 4:
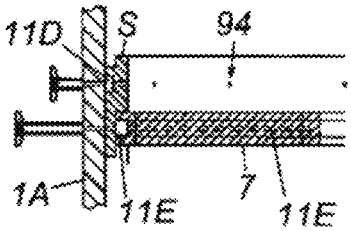

FIGS. 4A to 4E are explanatory diagrams illustrating Specific Structure Example 5 of the removing means RM, FIG. 4A is a plan view (broken state before assembly to the vacuum pump) illustrating the plurality of stator blades 7 to which the structure is applied, FIG. 4B is an enlarged view illustrating portion A in FIG. 4A, FIG. 4C is a sectional view seen along arrows D1 in FIG. 4B, FIG. 4D is a sectional view seen along arrows D2 in FIG. 4*c*, and FIG. 4E is a structural diagram illustrating an example in which the structure example of the removing means in FIGS. 4A to 4E is combined with the structure example of the removing means in FIGS. 3A to 3C.

Figure 5:
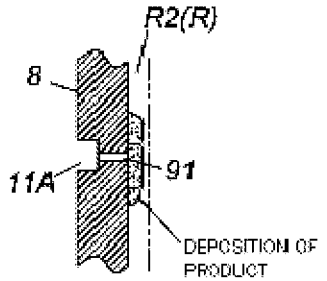
FIG. 5A, FIG. 5B, and FIG. 5C are sectional views illustrating injection holes that can be adopted in the vacuum pump in FIG. 1
FIG. 5D is an explanatory diagram illustrating the plurality of injection holes illustrated in FIG. 5C as seen from the front (from a thread groove exhaust flow path side)
Figure 5:
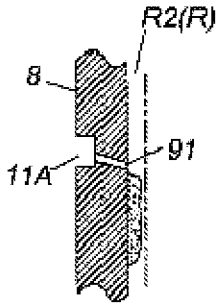
Figure 5:
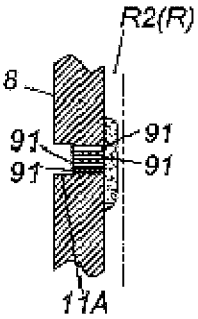
Figure 5:
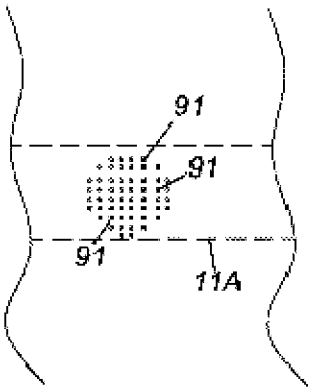

In Structure Example 5 in FIGS. 4A to 4E, the stator blade 7 (see FIG. 1) described above is provided with a fifth injection hole 95 and one end of the fifth injection hole 95 is opened in the outer surface of the stator blade 7 (see FIG. 5D). Structure Example 5 in FIGS. 4A to 4E also adopts a structure in which a removing gas supply path 11E is provided near the fifth injection hole 95 and a structure in which another end of the fifth injection hole 95 is opened to the removing gas supply path 11E.

Although gas introduction ports for the removing gas supply paths 11D and 11E are provided in FIG. 4E, a clearance (not illustrated) may be provided between the spacer S and the pump case 1A so as to supply the gas to the plurality of the removing gas supply paths 11D and 11E through one gas introduction port.

SPECIFIC STRUCTURE EXAMPLE OF INJECTION HOLES (NONPOROUS MATERIAL TYPE)

Any of the first to fifth injection holes 91, 92, 93, 94, and 95 may be formed by machine work such as boring with a drill or grooving with an end mill when a component (specifically, the thread groove exhaust portion stator 8, the ring material on the outer peripheral surface of the discharge port EX, the spacer S, or the stator blade 7) having these holes is made of a mechanically-machinable material such as a solid material or a cast material.

The plurality of first and second injection holes 91 and 92 and the plurality of fourth and fifth injection holes may be provided along the circumferential direction of the rotating body RT and the plurality of third injection holes 93 may be provided along the circumferential direction of the discharge port EX. In these cases, it is possible to appropriately changes the positions of the injection holes 91, 92, and 93 as needed by disposing these holes at regular intervals or concentrating these holes at positions at which products are easily disposed particularly.

The vacuum pump P1 in FIG. 1 adopts a structure in which the plurality of first injection holes 91 are provided along the circumferential direction of the rotating body RT, a structure in which a removing gas supply path 11A is provided near the first injection hole 91, and a structure in which another end of the first injection hole 91 is opened to the removing gas supply path 11A. In such a structure, the removing gas can be injected through any of the first injection holes 91 at the same time by simply supplying the removing gas to one removing gas supply path 11A.

[In addition, the vacuum pump P1 in FIG. 1 adopts a structure in which the plurality of second injection holes 92 are provided along the circumferential direction of the rotating body RT, a structure in which a removing gas supply path 11B is provided near the second injection hole 92, and a structure in which another end of the second injection hole 92 is opened to the removing gas supply path 11B. In such a structure, the removing gas can be injected at the same time from any of the second injection holes 92 by simply supplying the removing gas to one removing gas supply paths 11B.

Although the vacuum pump P1 in FIG. 1 adopts a structure in which the removing gas supply paths 11A and 11B are formed by a groove in the circumferential direction provided in the outer peripheral surface of the thread groove exhaust portion stator 8 and the inner surface of the casing 1 as specific structure examples of the removing gas supply paths 11A and 11B, the invention is not limited to this structure.

In addition, the vacuum pump in FIG. 1 adopts a structure in which the plurality of third injection holes 93 are provided along the circumferential direction of the discharge port EX, a structure in which a removing gas supply path 11C is provided near the third injection hole 93, and a structure in which another end of the third injection hole 93 is opened to the removing gas supply path 11C. In addition, the vacuum pump adopts, as a specific structure example of the removing gas supply path 11C, a structure in which a ring member is attached to the outer peripheral surface of the discharge port EX and the removing gas supply path 11C is formed by a groove in the inner surface of the attached ring member and the outer peripheral surface of the discharge port EX, the invention is not limited to these structures.

The first injection hole 91 may be formed so as to intersect with the flow path R a right angle as illustrated in FIG. 5A or may be formed so as to intersect with the flow path R diagonally as illustrated in FIG. 5B. These are also true of the second, third, fourth, and fifth injection holes 92, 93, 94, and 95. In addition, the plurality of first injection holes 91 may be provided along the pump shaft center direction as illustrated in FIG. 5C. These are also true of the second injection hole 92 and the fourth injection hole 94. Although not illustrated, the plurality of third injection holes 93 may be provided along the shaft center direction of the discharge port EX and the plurality of fifth injection holes 95 may be provided along the pump radial direction or the longitudinal direction of the stator blade 7.

In addition, when the plurality of first injection holes 91 are provided as described above, the injection holes 91 may be disposed in a matrix in a circular region as illustrated in FIG. 5D. This is also true of the other injection holes 92, 93, 94, and 95.

Overview of a Specific Structure of Injection Holes (Porous Material Type)

Since the above-mentioned components (specifically, the thread groove exhaust portion stator 8, the ring member of the outer peripheral surface of the discharge port EX, the spacer S, the stator blades 7, and the like) that form the inner wall surface of the flow path are generally made of a solid material or a cast material, the inner wall surface of the flow path is made of the same material (that is, a solid material or a cast material). However, in Specific Structure (Porous Material Type) Example 1 of Injection Holes, the inner wall surface of the flow path is made of a porous material and holes of the porous material are adopted as the injection holes.

Although the porous material that forms the inner wall surface of the flow path may be a metal material such as, for example, aluminum, stainless steel, or iron or may be a non-metal material such as ceramic or resin (plastic), the porous material is not limited to these materials.

Although the porous material may be formed by sintering and shaping metal powders (powder metallurgy), solidifying powders with a binding material (press forming), crashing a heated material at high speed into the surface of a base material to be made porous to form a porous film (thermal spraying), or using a three-dimensional printer, the porous material may be formed by another method.

SPECIFIC STRUCTURE (POROUS MATERIAL TYPE) EXAMPLE 1 OF INJECTION HOLES

Figure 6:
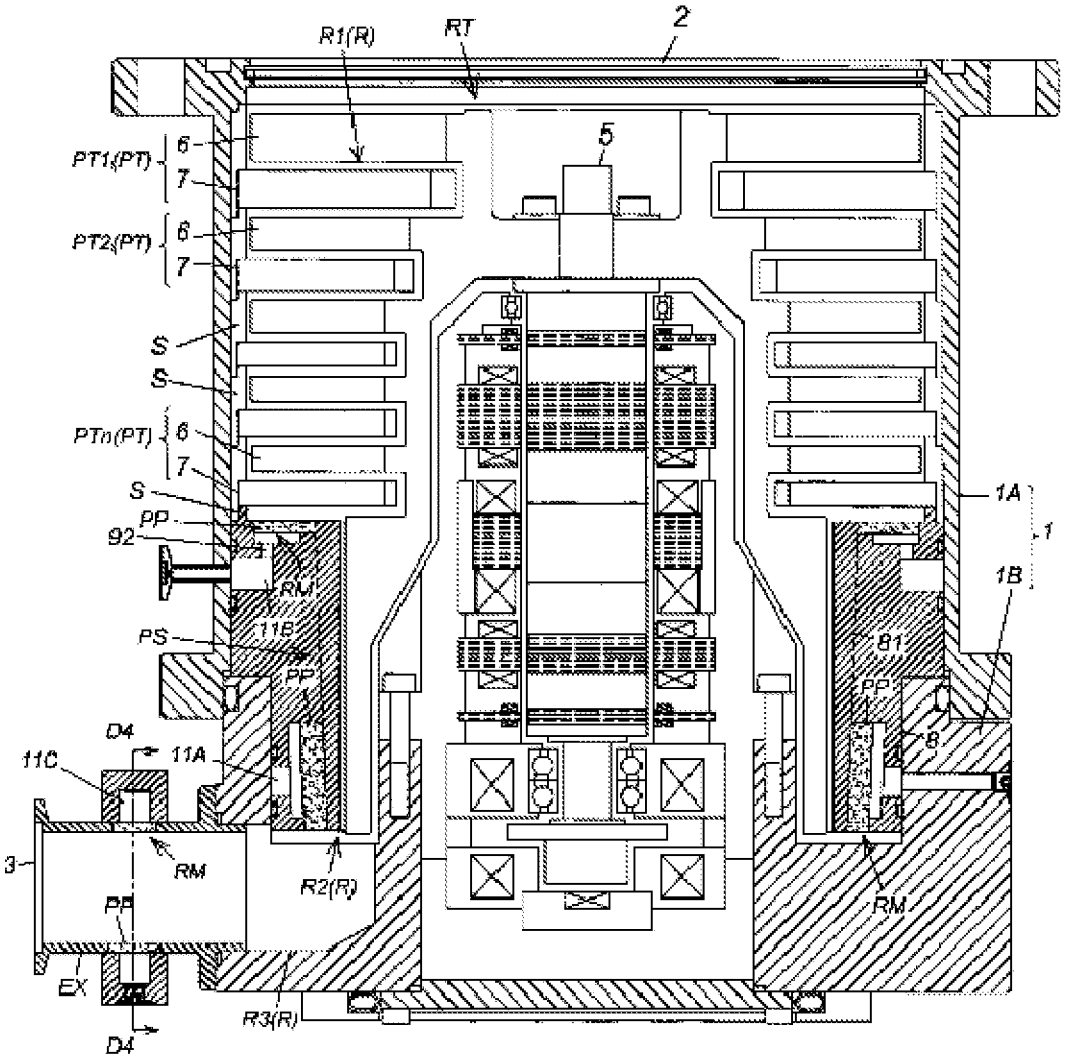
FIG. 6 is an explanatory diagram illustrating a specific structure (porous material type) example 1 of the injection holes.
Figure 7:
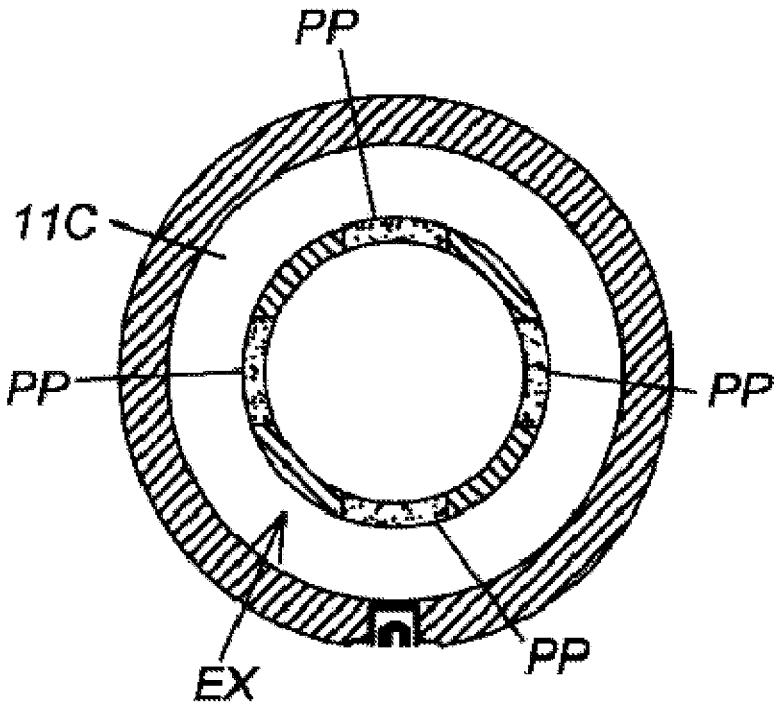
FIG. 7 is a sectional view seen along arrows D4 in FIG. 6.
Figure 8:
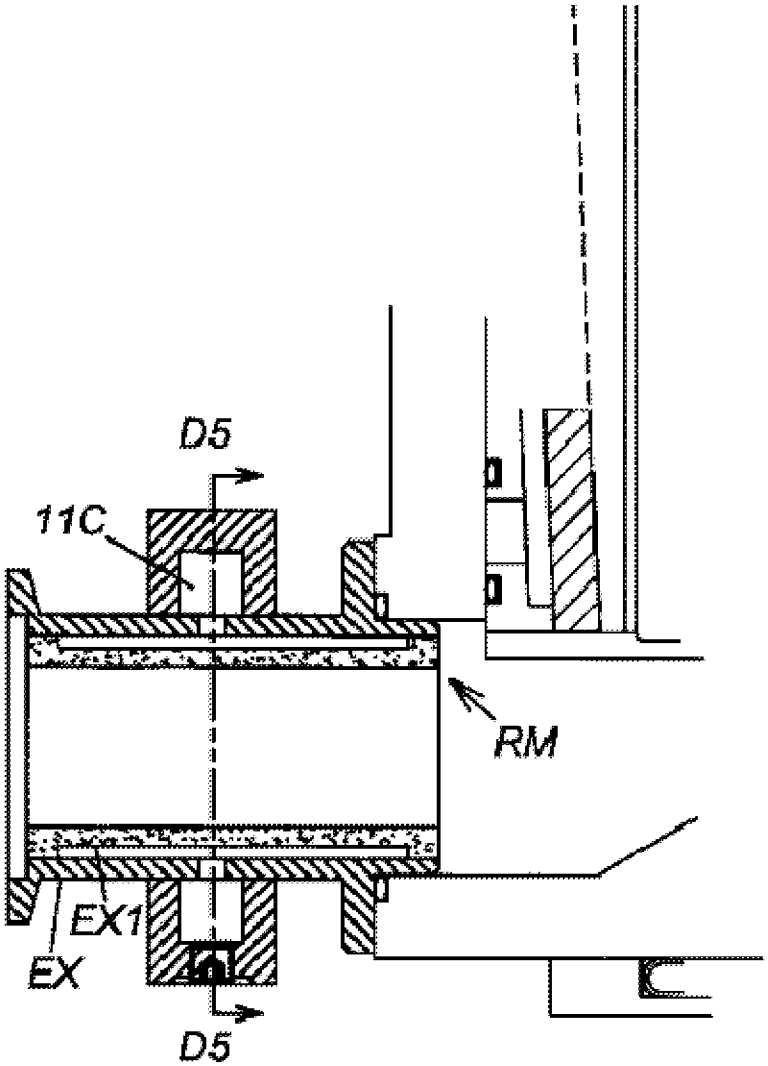
FIG. 8A is a sectional view illustrating vicinity of a discharge port and FIG. 8B is a sectional view seen along arrows D5 in FIG. 8A.
Figure 8:
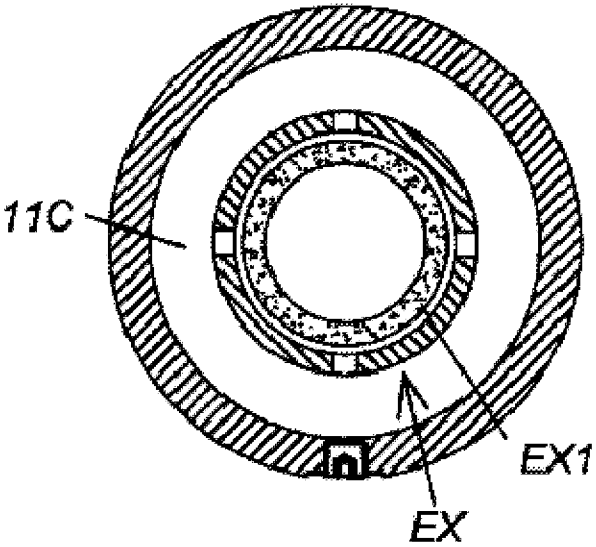

FIG. 6 is an explanatory diagram illustrating a specific structure (porous material type) example 1 of the injection holes, FIG. 7 is a sectional view seen along arrows D4 in FIG. 6, FIG. 8A is a sectional view illustrating the vicinity of the discharge port, and FIG. 8B is a sectional view seen along arrows D5 in FIG. 8A.

In the structure (porous type) example 1 in FIG. 6, by replacing parts (specifically, the vicinity of the first injection hole 91 in FIG. 1 and the vicinity of the second injection hole 92 in FIG. 1 described above) of the thread groove exhaust portion stator 8 with a porous material as a porous portion PP, the inner wall surface of the flow path (specifically, the downstream end of the thread groove exhaust flow path R2 and the upstream end of the thread groove exhaust flow path R2 that communicates with the final clearance GE) is made of the porous material and the removing gas can be injected into the flow path through holes of the porous material.

In addition, in this structure (porous type) example 1 in FIG. 6, by replacing a part (specifically, the vicinity of the third injection hole 92 in FIG. 1 described above) of the discharge port EX with a porous material as the porous portion PP, the inner wall surface of the flow path (specifically, the discharge port EX) is made of the porous material and the removing gas can be injected into the flow path through holes of the porous material.

When a part of the discharge port EX is formed by the porous portion PP as described above, the plurality of porous portions PP may be disposed at a predetermined pitch in the circumferential direction of the discharge port EX, as illustrated in, for example, FIG. 7.

In addition, a cylindrical porous cylinder EX1 made of a porous material may be inserted into the inside of the discharge port EX as illustrated in, for example, FIG. 8A and FIG. 8B to configure the inner wall surface of the discharge port EX with the porous material. Although the whole inner wall surface of the discharge port is configured by the porous material by making the whole length of the porous cylinder EX1 substantially identical to that of the discharge port EX in FIG. 8A and FIG. 8B, the present invention is not limited to this example. The length of the porous cylinder EX1 may be changed as appropriate within the range of the whole length of the discharge port EX.

SPECIFIC STRUCTURE (POROUS MATERIAL TYPE) EXAMPLE 2 OF INJECTION HOLES

Figure 9:
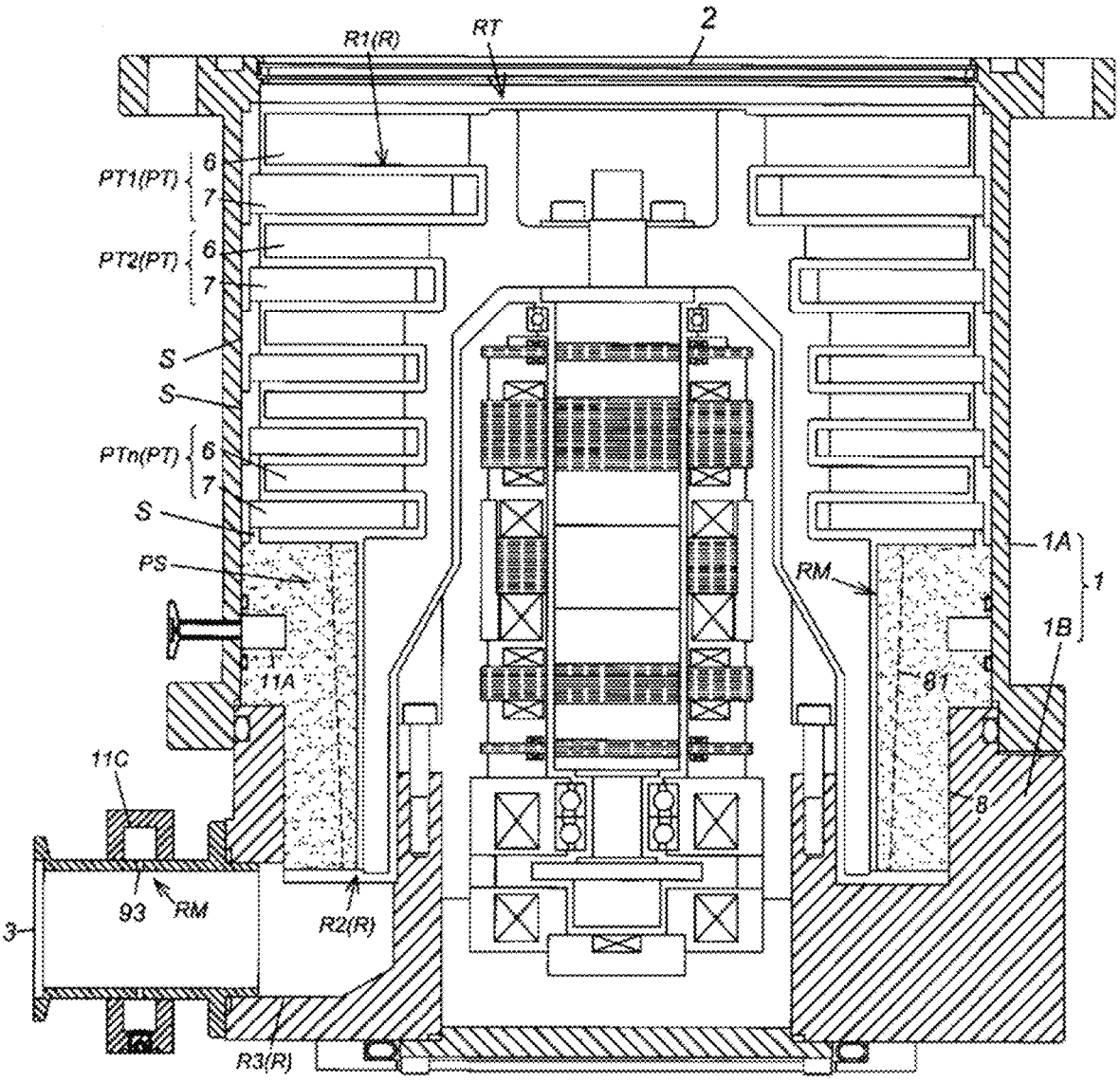
FIG. 9 is an explanatory diagram illustrating a specific structure (porous material type) example 2 of the injection holes.
Figure 10:
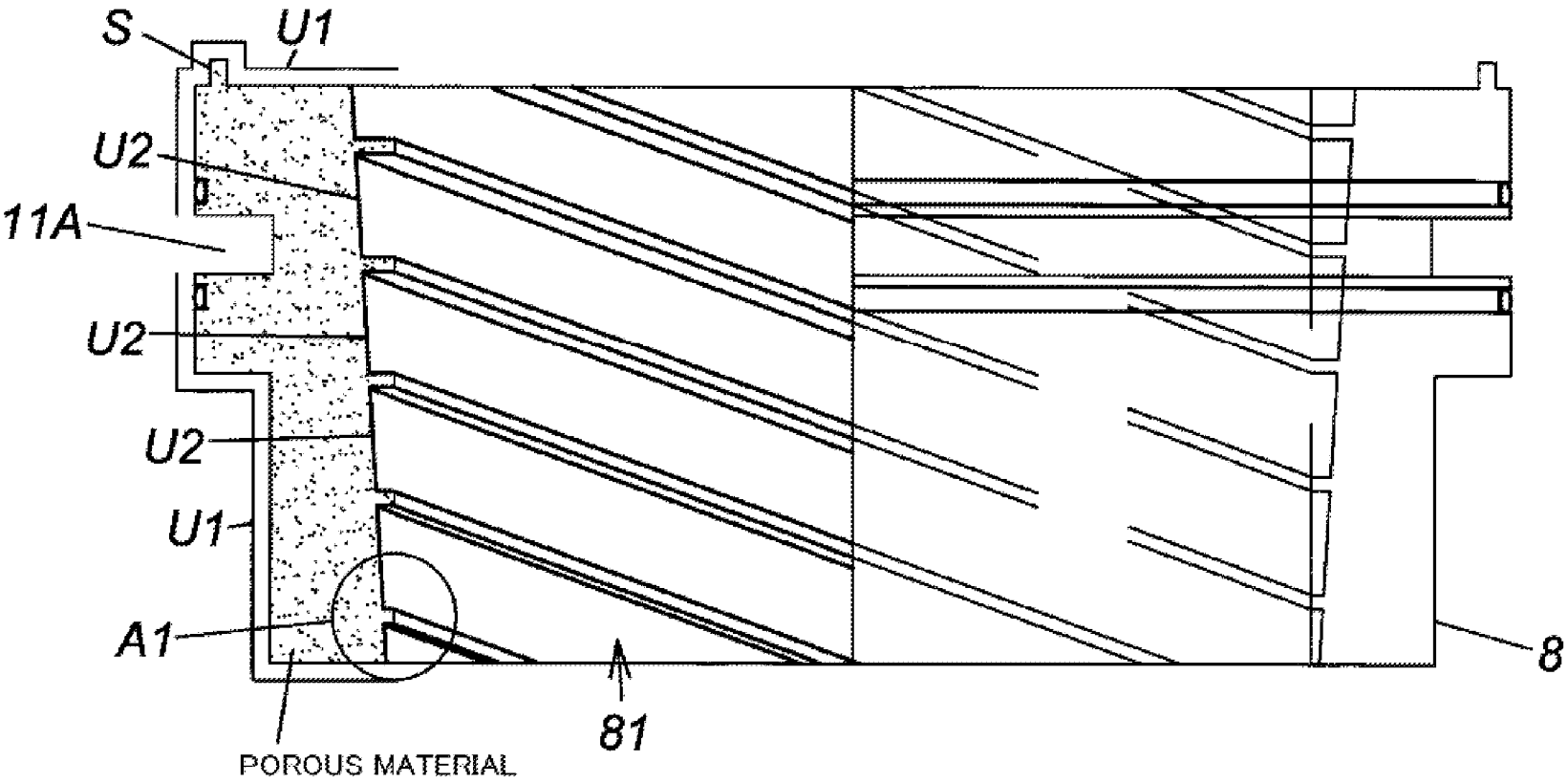
FIG. 10 is an enlarged sectional view illustrating a thread groove exhaust portion stator in FIG. 9.
Figure 11:
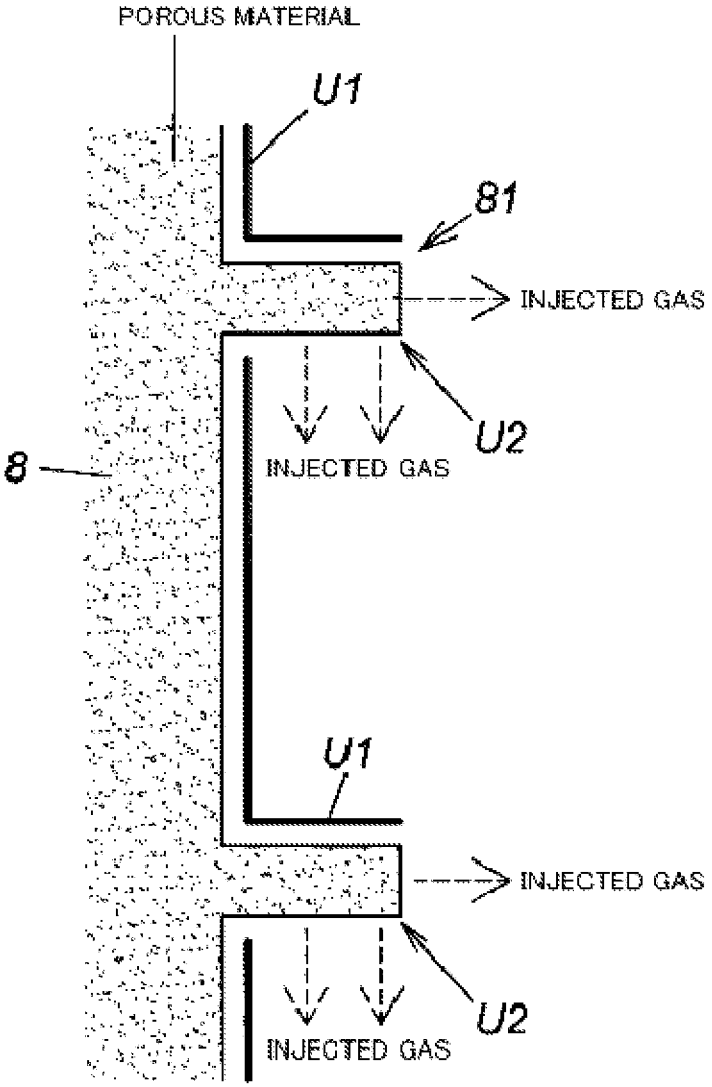
FIG. 11 is an enlarged view illustrating vicinity of a portion A1 in FIG. 10.
Figure 12:
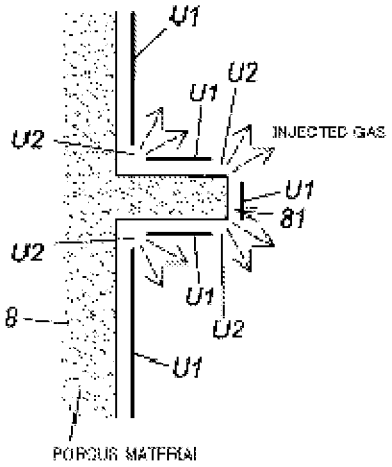
FIG. 12A and FIG. 12B are enlarged views illustrating the vicinity of the portion A1 in FIG. 10.
Figure 12:
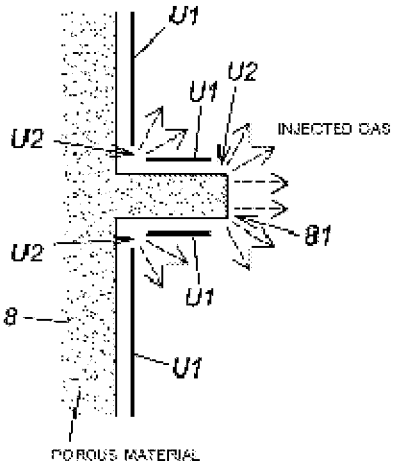

FIG. 9 is an explanatory diagram illustrating a specific structure (porous material type) example 2 of the injection holes, FIG. 10 is a sectional view illustrating the thread groove exhaust portion stator to which the structure (porous material type) example 2 in FIG. 9 is applied, and FIG. 11, FIG. 12A, and FIG. 12B are enlarged views illustrating the vicinity of a portion A1 in FIG. 10.

In this structure (porous material type) example 1 in FIG. 9, the injection section can be narrowed and the removing gas can be injected through holes of a non-masked portion U2 within the range of a non-masked portion U2 by adopting a structure in which the inner wall surface of the flow path (specifically, the thread groove exhaust flow path R2) is configured by a porous material by creating the whole thread groove exhaust portion stator 8 using a porous material and a structure (referred to below as a porous masking structure) in which a part of the surface of the porous material constituting the inner wall surface is masked by a masking member U1 (see FIG. 11, FIG. 12A, and FIG. 12B) and the portion other than the part is configured as a non-masked portion U2 (see FIG. 11, FIG. 12A, FIG. 12B).

Although the whole thread groove exhaust portion stator 8 is formed by a porous material in the porous masking structure described above, only the portion of the whole thread groove exhaust portion stator 8 that constitutes the inner wall surface of the thread groove exhaust flow path R2 may be formed by a porous material.

In addition, in the structure (porous material type) example 1 in FIG. 9, although a structure in which an upward surface of the thread groove 81 that constitutes the inner wall surface of the thread groove exhaust flow path R2 (flow path) is configured as the non-masked portion U2 as illustrated in FIG. 11 or the vicinity of a corner portion of the thread groove 81 is set as the non-masked portion U2 as illustrated in FIG. 12A, or a structure in which the vicinity of the corner portion of the thread groove 81 and a thread crest of the thread groove 81 are set as the non-masked portion U2 as illustrated in FIG. 12B is adopted, the present invention is not limited to this example. A portion of the thread groove exhaust flow path R2 (flow path) to be configured as the non-masked portion U2 can be changed as appropriate in consideration of a position in which a product is easily deposited.

By the way, it is difficult to form an injection hole in the wall surface or the corner portion of the thread groove 81 by machine work such as boring with a drill or grooving with an end mill. In contrast, it is relatively easy to mask a section other than the wall surface or the corner portion described above using the masking member U1 because machine work is not necessary. Accordingly, the structure (referred to below as the non-masked portion injection structure) in which the removing gas can be injected into the flow path through holes of a porous material within the range of the non-masked portion U2 as described above is advantageous because of applicability to a narrow space in which machine work is difficult.

The porous masking structure and the non-masked portion injection structure described above are applicable to not only the first injection hole 91, but also the second and third injection holes 92 and 93 and the fourth and fifth injection holes 94 and 95.

Figure 13:
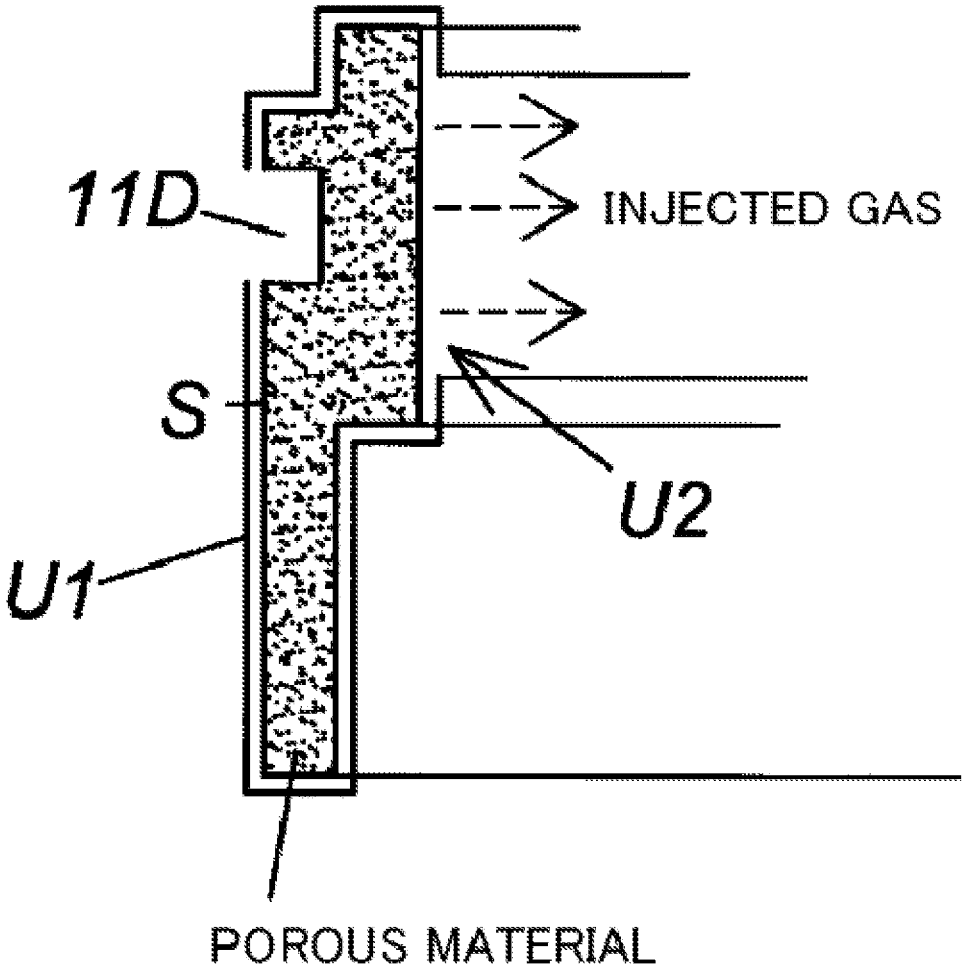
FIG. 13 is an explanatory diagram illustrating an example of forming the fourth injection hole using holes of a porous material in a structure in which the fourth injection hole is provided in the spacer.

FIG. 13 illustrates an example of forming the fourth injection hole 94 using holes of a porous material in the structure having the fourth injection hole 94 in the spacer S and FIG. 14A and FIG. 14B illustrate examples of forming the fifth injection hole 95 using holes of a porous material in the structure having the fifth injection hole 95 in the stator blade 7. In any of these examples, the injection section can be narrowed by adopting the porous masking structure described above and the removing gas can be injected into the flow path through holes of the porous material within the range of the non-masked portion U2.

Specifically, in the example in FIG. 13, by configuring the inner surface of the spacer S constituting the flow path (inter-blade exhaust flow path R1) as the non-masked portion U2 so that the removing gas is injected only through the inner surface of the spacer S. In addition, in the examples in FIG. 14A and FIG. 14B, by configuring, as the non-masked portion U2, the vicinity (see FIG. 14A) of a corner portion on the downstream side of the stator blade 7 constituting the flow path (inter-blade exhaust flow path R1) or a part (see FIG. 14B) or all (not illustrated) of a downward surface on the downstream side of the stator blade 7, so that the removing gas is injected only from the vicinity of the corner portion on the downstream side of the stator blade 7 or the downward surface on the downstream side of the stator blade 7.

The whole stator blade 7 can be made of a porous material and the masking described above can be omitted as illustrated in FIG. 14C. In this case, the removing gas can be injected from any of the surfaces of the stator blade 7.

SPECIFIC STRUCTURE (POROUS MATERIAL TYPE) EXAMPLE 2 OF INJECTION HOLES

Figure 15:
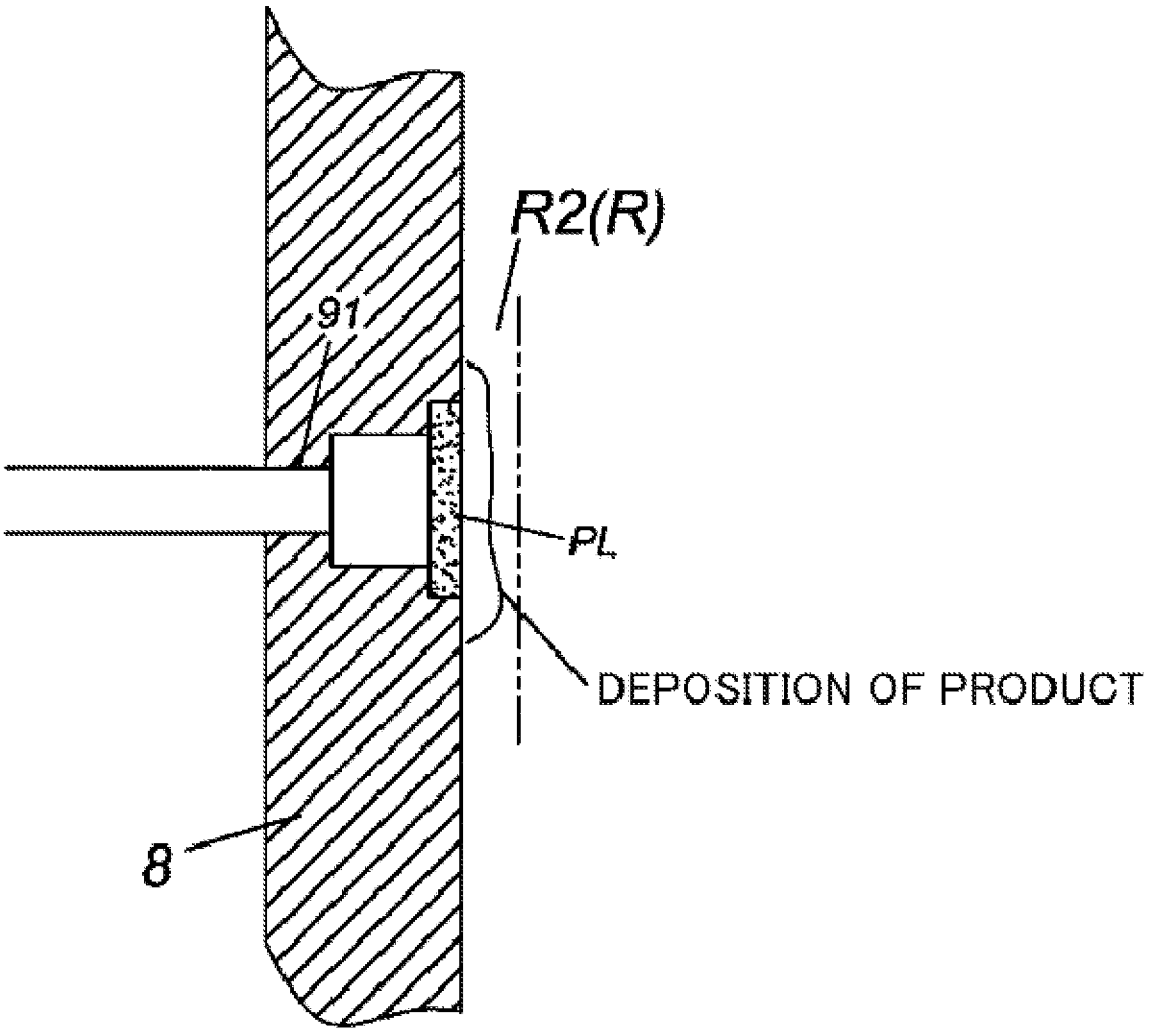
FIG. 15 is an explanatory diagram illustrating a specific structure (porous material type) example 3 of the injection hole.

FIG. 15 is an explanatory diagram illustrating a specific structure (porous material type) example 3 of the injection hole.

In the structure (porous material type) example 3 in FIG. 15, a plate body PL having a surface area larger than an opening area of the first injection hole 91 (see FIG. 1) described above is provided near the opening end of the first injection hole 91, the plate body PL is made of a porous material, and holes of the porous material are adopted as the injection holes. Such a structure (referred to below as a porous plate injection structure) enlarges the gas injectable area in the structure (porous material type) example 3 in FIG. 15.

Figure 16:
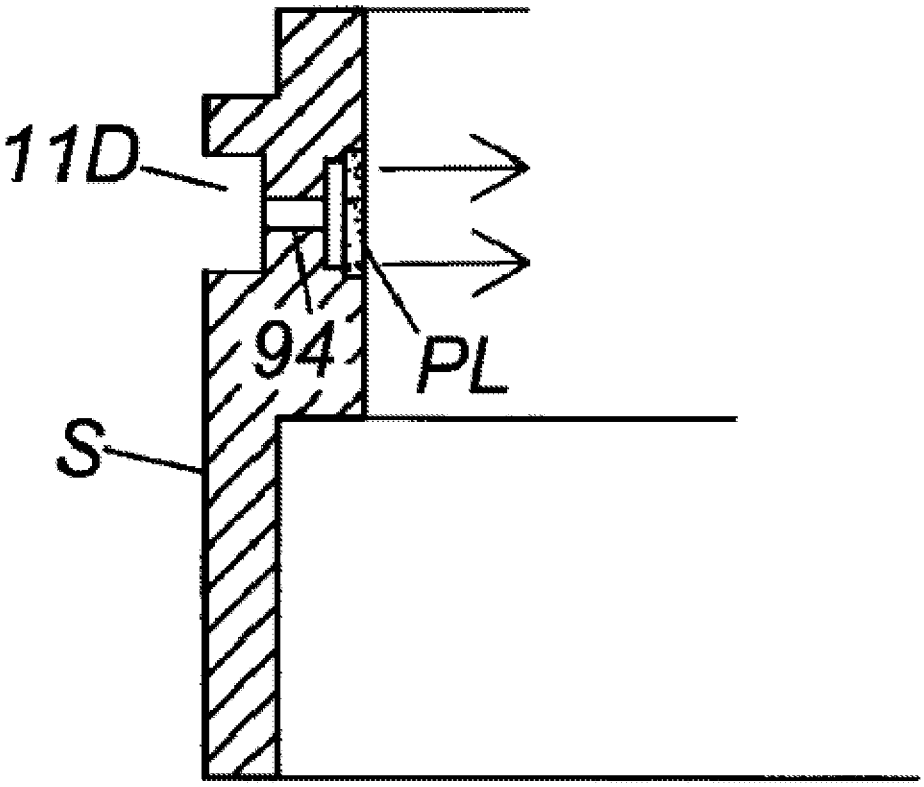
FIG. 16 is an explanatory diagram illustrating an example of applying a porous plate injection structure in a structure in which the fourth injection hole is provided in the thread groove exhaust portion stator.
Figure 17:
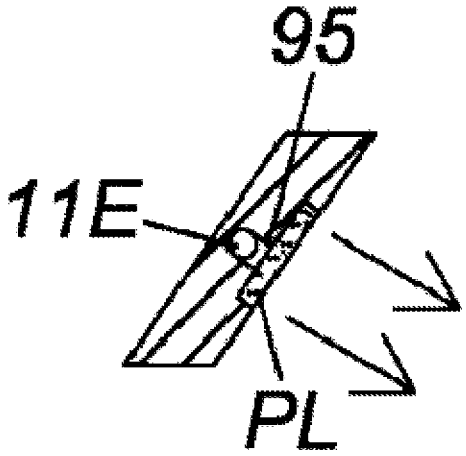
FIG. 17 is an explanatory diagram illustrating an example of applying the porous plate injection structure in a structure in which the fifth injection hole is provided in the stator blade.

The porous plate injection structure described above is applicable to not only the first injection hole 91, but also the second and third injection holes 92 and 93 and the fourth and fifth injection holes. FIG. 16 illustrates an example of applying the porous plate injection structure described above in a structure in which the fourth injection hole 94 is provided in the thread groove exhaust portion stator 8 and FIG. 17 illustrates an example of applying the porous plate injection structure described above in a structure in which the fifth injection hole 95 is provided in the stator blade 7. That is, in any of these examples, the plate body PL made of a porous material is provided near the opening ends of the injection holes 94 and 95 and holes of the porous material are adopted as the injection holes.

Description of a Gas Injected Through Injection Holes

In the vacuum pump P1 in FIG. 1, an inert gas, a high-temperature gas heated by heating means, or a high-energy gas (such as, for example, a gas that is put in a plasma or radical state by a plasma generation device) activated by exciting means can be adopted as the removing gas to be injected through the gas injection holes 91, 92, and 93. These removing gases may be appropriately selected or combined as needed.

An example of an inert gas is a nitrogen gas or a noble gas (such as an argon gas, a krypton gas, or a xenon gas) and these poorly-reactive gases are preferably used when an injected gas reacts with a process gas to possibly cause an explosion or generate toxins. It should be noted here that use of a gas with a large molecular weight increases the kinetic energy of the injected gas and thereby improves removal effects.

Since a high-energy gas or a high-temperature gas has an energy density larger than a gas at normal temperature, such a gas has a larger effect of removing a product deposited on the inner surface of the flow path R through injection from the gas injection holes 91, 92, and 93.

Description of the Control Means CX

The vacuum pump P1 in FIG. 1 has control means CX that performs centralized control of the whole vacuum pump P1, such as startup and restart thereof, support control of the rotating body RT with the magnetic hearings MB1 and MB2, and control of the number of revolutions or control of rotating speed of the rotating body RT via the driving motor MO.

As a specific structure example of this type of the control means CX, the control means CX is configured by an arithmetic processing apparatus including hardware resources such as, for example, a CPU, a ROM, a RAM, and an input-output (I/O) interface in the vacuum pump P1 in FIG. 1, but the present invention is not limited to this example.

The control means CX functions as means for performing centralized control of the whole vacuum pump P as described above and also functions as means for supplying a gas to the injection holes 91, 92, and 93 based on an instruction (specifically, the maintenance permission signal) from the external device M.

Figure 19:
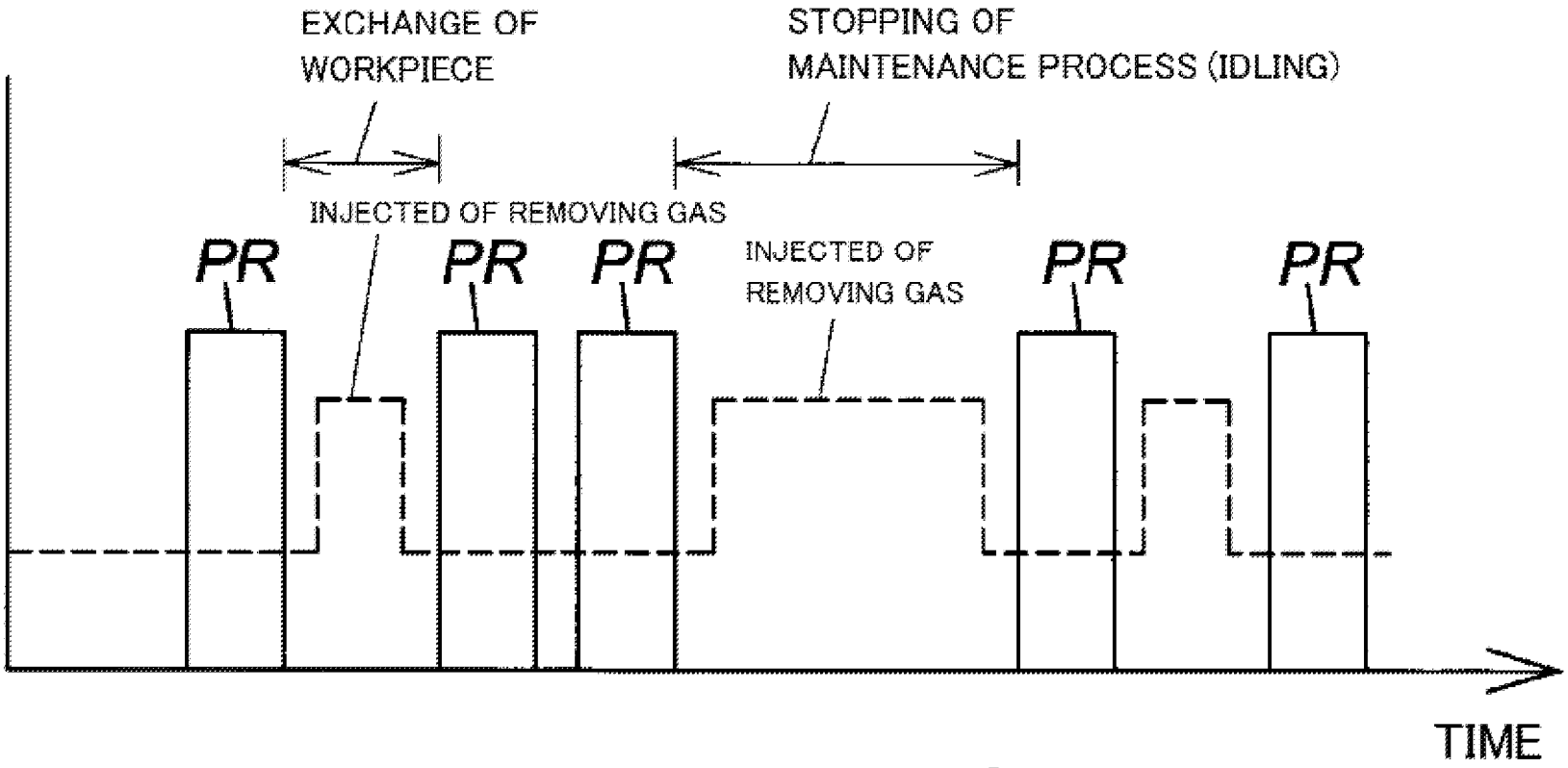
FIG. 19 illustrates the relationship between processes by the external device and injection timing of a removing gas.

In this case, the external device M may output the instruction (specifically, the maintenance permission signal) at regular intervals. In addition, to prevent effects on operation of the external device M, the instruction from the external device M is preferably output at a timing at which the degree of vacuum of the external device M is not affected, such as in a period between processes executed by the external device M, a workpiece exchange period, or a maintenance period of the vacuum pump P1, as illustrated in FIG. 19.

The instruction (specifically, the maintenance permission signal) may include information about a gas to be injected, such as the type and the control method of a gas to be injected through the injection holes 91, 92, and 93.

The execution by the control means CX may include processing that outputs a maintenance request signal RQ to the external device M and processing that outputs a signal required to supply a gas to the injection holes 91, 92, and 93 when receiving an instruction (specifically, a maintenance permission signal EN) output from the external device M in response to the maintenance request signal RQ, as illustrated in FIG. 2.

The maintenance request signal RQ can be output to the external device M via an input-output (I/O) interface of the control means CX and the maintenance permission signal can also be received via the input-output (I/O) interface of the control means CX.

The signal (that is, the signal required to supply a gas to the injection holes 91, 92, and 93) may be output to valves BL1, BL2, BL3, and BL4 described later via an input-output (I/O) interface.

Description of a Gas Injection Control Method by the Control Means CX

The control means CX may function as means for controlling any of the pressure, the flowrate, and the injection time of the removing gas as the injection control method for the removing gas injected through the injection holes 91, 92, and 93.

In addition, the control means CX may function as means for controlling all of the above control targets (the pressure, the flowrate, and the injection time) described above or may function as means for controlling any two (the pressure and the flowrate, the pressure and the injection time, or the flowrate and the injection time) of the control targets.

The control of the injection time by the control means CX may include at least either one of control that constantly injects the removing gas through the injection holes 91, 92, and 93 and control (referred to below as intermittent injection control) that intermittently injects the removing gas through the injection holes 91, 92, and 93.

The control of the flowrate by the control means CX may include at least either one of control that keeps the flowrate of the removing gas injected through the injection holes 91, 92, and 93 constant and control that increases or reduces the flowrate.

The control of the pressure by the control means CX may include at least either one of control that keeps the pressure of the removing gas injected through the injection holes 91, 92, and 93 constant and control (referred to below as a projecting manner gas injection control) that supplies the removing gas injected through the injection holes 91, 92, and 93 to the injection holes in a projecting manner.

The control of the injection time, the flowrate, and the pressure in the control means CX described above can be achieved, as illustrated in, for example, FIG. 2, by installing the valves BL1 and BL2 at a midpoint of a gas supply system SS that supplies the removing gas to the injection holes 91, 92, and 93 and controlling the valve BL2 using the control means CX.

Figure 18:
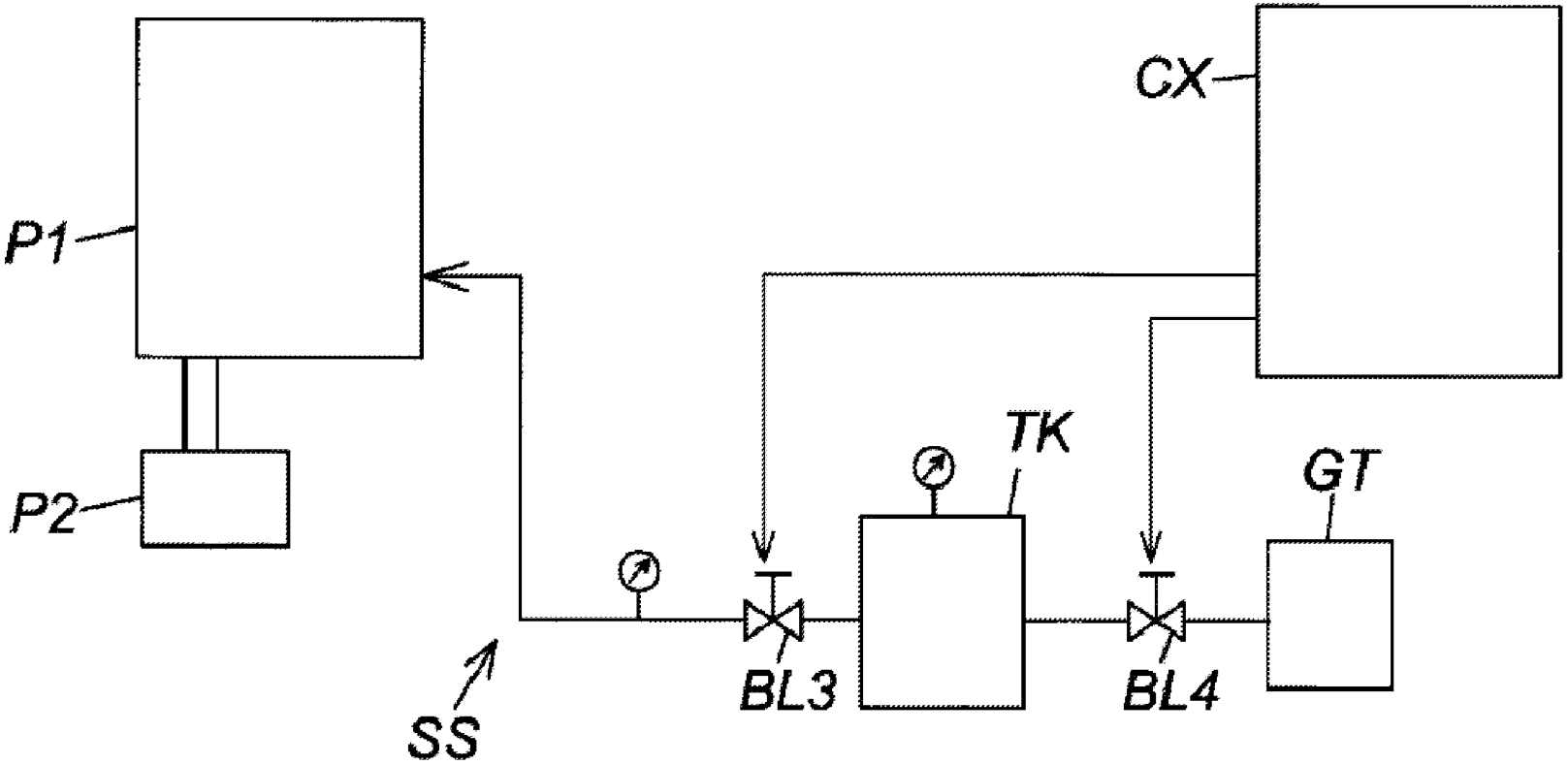
FIG. 18 is an explanatory diagram illustrating projecting manner gas injection control.

Regarding the projecting manner gas injection control, the removing gas may be released from the surge tank TK toward the injection holes 91, 92, and 93 at a single burst by providing a surge tank TK capable of temporality reserving the removing gas at a midpoint of a gas supply system SP as illustrated in, for example, FIG. 18 and opening the valve BL4 located upstream of this surge tank TK.

Although the control means CX may adopt a method that makes control so that the injection holes 91, 92, and 93 constantly inject the removing gas, the injection holes 91, 92, and 93 preferably inject the removing gas only when the maintenance request signal is output to the external device M and the instruction (specifically, the maintenance permission signal) from the external device M is received to reduce effects on processes in the external device M as much as possible.

Example in which Detection Means is Simultaneously Used in the Control Means CX

Referring to FIG. 2, detection means MM that detects the supply situation of the gas supply system SS is provided at a midpoint of the gas supply system SS that supplies the removing gas to the injection holes 91, 92, and 93 in the vacuum pump P1 in FIG. 1. It is possible to adopt measuring means for numerically measuring the supply state (specifically, the pressure and the flowrate) of the gas supply system SP, for example, a well-known pressure gauge or flowmeter) as this type of the detection means MM.

When the detection means MM is adopted in the vacuum pump P1 in FIG. 1, the control means CX may function as means for outputting a signal required to adjust the supply pressure or the supply flowrate of the removing gas with respect to the injection holes 91, 92, and 93 based on a detection result by the detection means MM.

First Structure Example and Third Structure Example below may be adopted as a specific structure for achieving the function described above. First Structure Example and Third Structure Example described below may be practiced separately or together.

Estimation Principle of Deposition Amount of a Product

Since the measurement value (pressure) of the detection means MM (pressure gauge) rises and is kept high (see FIG. 20) when clogging occurs in the injection holes 91, 92, and 93 or the gas supply system SS due to deposition of a product, the control means CX can estimate the estimated deposition amount of the product by monitoring changes in the measurement value (pressure) of the detection means MM.

In addition, since the measurement value (flowrate) of the detection means MM (tlowmeter) is reduced when the clogging occurs, the control means CX can estimate the estimated deposition amount of the product by monitoring changes in the measurement value (flowrate) of the detection means MM.

Figure 20:
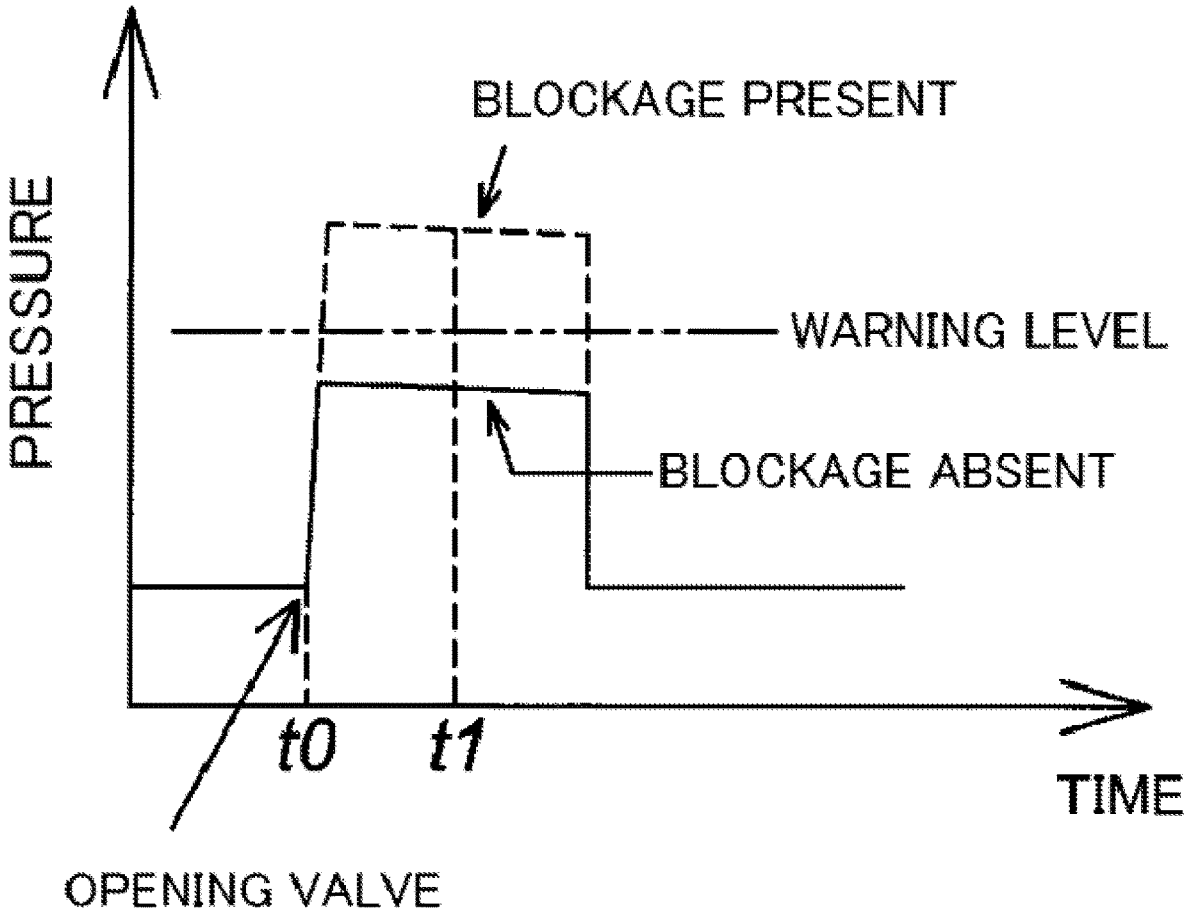
FIG. 20 is an explanatory diagram illustrating changes in the pressure of the removing gas when clogging occurs in the injection hole or the gas supply system has by disposition of a product.

In addition, as illustrated in FIG. 20, the control means CX may grasp the blockage level of the gas supply system SS and the deposition level of a product based on the measurement values (pressure and flowrate) measured by the measuring means MM (pressure gauge and flowmeter) after a lapse of a predetermined time (t1) from an injection start time (t0) of the removing gas at which the removing gas is injected through the injection holes 91, 92, and 93.

FIRST STRUCTURE EXAMPLE

A pressure gauge is adopted as the measuring means MM.

The control means CX adopts processing that receives the measurement value (pressure) by the pressure gauge via the input-output (I/O) interface, processing that determines whether the received measurement value (pressure) exceeds a threshold (for example, an alarm level illustrated in FIG. 20) via a CPU, and processing that increases the supply pressure of the removing gas with respect to the injection holes 91, 92, and 93 by outputting a predetermined signal to the valve BL2 via the input-output (I/O) interface when this determination processing determines that the threshold is exceeded.

SECOND STRUCTURE EXAMPLE

A flowmeter is adopted as the measuring means MM.

The control means CX adopts processing that receives the measurement value (flowrate) of the flowmeter via the input-output (I/O) interface described above, processing that determines whether the received measurement value (flowrate) is less than a threshold via the CPU, and processing that increases the supply flowrate or the supply pressure of the removing gas with respect to the injection holes 91, 92, and 93 by outputting a predetermined signal to the valve BL2 via the input-output (I/O) interface when this determination processing determines that the received measurement value is less than the threshold.

THIRD STRUCTURE EXAMPLE

A pressure gauge is adopted as the measuring means MM.

The control means CX adopts processing that constantly or periodically monitors changes in the measurement value (pressure) of the measuring means MM, processing that estimates a deposition amount of a product based on changes in the measurement value (pressure), and processing that increases the supply amount of the removing gas with respect to the injection holes 91, 92, and 93 by outputting the predetermined signal to the valve BL2 as described in First Structure Example or sounds an alert by outputting a predetermined signal to an alarm device (not illustrated) when the estimated deposition amount of the product exceeds a threshold.

FOURTH STRUCTURE EXAMPLE

A flowmeter is adopted as the measuring means MM.

The control means CX adopts processing that constantly or periodically monitors changes in the measurement value (flowrate) of the measuring means MM, processing that estimates a deposition amount of a product based on changes in the measurement value (flowrate), and processing that increases the supply flowrate or the supply pressure of the removing gas with respect to the injection holes 91, 92, and 93 by outputting the predetermined signal to the valve BL2 as described in Second Structure Example or sounds an alert by outputting a predetermined signal to an alarm device (not illustrated) when the estimated deposition amount of the product exceeds a threshold.

ADDITIONAL STRUCTURE EXAMPLE

When the above-mentioned blockage level of the gas supply system SS becomes high, the control means CX may perform control (referred to below as stepwise gas pressure rise control) so as to increase the gas supply pressure of the gas supply system SS in a stepwise manner. In this case, an alarm level that depends on the step may be set and output.

If a deposition (that is, a product deposited in the injection holes 91, 92, and 93 or the gas supply system SS) that causes blockage of the gas supply system SS is removed and the blockage of the gas supply system SS is solved by increasing the gas supply pressure in a stepwise manner as described above, the gas pressure of the gas supply system SS returns to the original pressure. Accordingly, stepwise gas pressure rise control may be cancelled by detecting the original pressure.

When correspondence only by stepwise gas pressure rise control is difficult, the control means CX may make a transition to processing having a larger effect of removing the deposited product (A→B→C) by shifting to processing (A) that switches to the intermittent injection control described above, processing (B) that switches the type of the removing gas to be injected through the injection holes 91, 92, and 93 from, for example, an inert gas at normal temperature to a high-temperature gas, processing (C) that switches the type of the removing gas from a high-temperature gas to a high-energy gas and the like.

When removal of the deposited product by injecting a gas through the injection holes 91, 92, and 93 becomes difficult, the control means CX may prompt the overhaul maintenance or replacement of the vacuum pump by outputting a predetermined signal (HELP signal) to the external device M.

SUMMARY

In the vacuum pump P1 according to the embodiment, the removing means RM adopts, as a specific structure of the removing means RM for removing the product deposited on the inner wall surface of the flow path R, the structure in which the removing means RM has the injection hole 91, 92, and 93, 94, or 95 with one ends opened at the inner wall surface of the flow path R and injects the removing gas into the flow path R through the injection hole 91, 92, and 93, 94, or 95. Accordingly, since the product deposited on the inner wall surface of the flow path R is forcibly peeled off and removed by a physical force of the removing gas injected through the injection hole 91, 92, 93, 94, or 95 unlike conventional heating and thermal insulation of a pump, failures (such as, for example, breakage due to reduction in the material strength of the rotating body RT, deformation due to creep strain of the rotating body RT, contact between the deformed rotating body RT and the stator component located on the outer periphery thereof, and breakage of the rotating body RT or the stator component due to the contact) are not caused by conventional heating and thermal insulation of the pump and this structure is suited for removal of the product deposited in the flow path R in the vacuum pump P1.

In addition, since the heating and thermal insulation of the pump can also be used together in the vacuum pump P1 according to the embodiment, the energy required for the heating and thermal insulation of the pump can be reduced.

In addition, if the removing gas is injected through the injection holes 91, 92, and 93 only when the maintenance request signal is output to the external device M and the instruction (specifically, the maintenance permission signal) from the external device M is received in the vacuum pump P1 according to the embodiment, effects of the injection of the removing gas on processes in the external device M can be suppressed and effects on the operation of the external device NI can be prevented.

The present invention is not limited to the embodiment described above and those skilled in the art can make various modifications within the technical spirit of the present invention.

For example, the present invention is also applicable to a structure in which the thread groove pump stage PS is omitted from the vacuum pump P1 illustrated in FIG. 1, that is, a vacuum pump (so-called turbo molecule pump) that exhausts a gas using only the blade exhaust stages PT.

Since the thread groove pump stage PS illustrated FIG. 1 is omitted in the example to which the present invention is applied, the second injection hole 92 and the removing gas supply path 11B illustrated in FIG. 1 are disposed on the pump base 1B. In addition, in the example to which the present invention is applied, the final clearance GE that communicates with the downstream exit of the inter-blade exhaust flow path R1 (flow path formed by the clearance set between the rotor blades 6 provided on the outer peripheral surface of the rotating body R and the stator blades 7 positioned and fixed in the casing 1) is configured as the clearance between the stator blade 7E or the rotor blade 6 constituting the lowest blade exhaust stage PTn and the pump base 1B. In this case, since a product may be deposited in a portion of the inner wall surface (specifically, a surface of the pump base 1B that constitutes the final clearance GE) of the inter-blade exhaust flow path R1 close to a downstream exit of the inter-blade exhaust flow path R1, one end of the second injection hole 92 may be opened in the portion of the inner wall surface of the inter-blade exhaust flow path R1 close to the downstream exit of the inter-blade exhaust flow path R1 to remove the deposited product.

In addition, the present invention is also applicable to a drag pump of radial-flow type (such as Siegbahn type) in addition to an axial-flow vacuum pump such as the vacuum pump P1 according to the embodiment described above.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump comprising:

a rotating body disposed in a casing;

supporting means rotatably supporting the rotating body;

driving means configured to rotationally drive the rotating body;

an inlet port configured to suck gas by rotation of the rotating body;

an outlet port configured to exhaust the gas sucked through the inlet port;

a flow path through which the gas is transferred from the inlet port toward the outlet port; and removing means configured to remove a product deposited on an inner wall surface of the flow path, wherein the removing means has an injection hole with one end opened at the inner wall surface of the flow path and removing gas is injected into the flow path through the injection hole, the vacuum pump comprises control means configured to function as means for performing control of any of pressure, a flowrate, and an injection time of the removing gas, and the control of the pressure includes at least either one of control in a form of keeping the pressure of the removing gas injected through the injection hole constant and control in a form of supplying, to the injection hole in a projecting manner, the removing gas injected through the injection hole.

2. The vacuum pump according to claim 1, wherein detection means configured to detect a supply situation by a gas supply system configured to supply the removing gas to the injection hole is provided at a midpoint of the gas supply system.

3. The vacuum pump according to claim 2, wherein the control means functions as means for outputting a signal required to adjust supply pressure or a supply flowrate of the removing gas with respect to the injection hole on the basis of a detection result by the detection means.

4. The vacuum pump according to claim 2, wherein the control means functions as means for estimating a deposition amount of a product on the basis of a detection result by the detection means and, when the estimated deposition amount exceeds a threshold, outputting a signal required to adjust supply pressure or a supply flowrate of the removing gas with respect to the injection hole or outputting a signal required to sound an alert.

5. The vacuum pump according to claim 1, wherein the control means functions as means for performing supply of the removing gas to the injection hole on the basis of an instruction from an external device.

6. The vacuum pump according to claim 5, wherein the supply based on the instruction includes processing that outputs a maintenance request signal to the external device and processing that outputs a signal required for the supply of the removing gas to the injection hole when a maintenance permission signal output from the external device in response to the maintenance request signal is received.

7. The vacuum pump according to claim 1, wherein
the control of the injection time includes at least either one of control in a form of constantly injecting the removing gas through the injection hole and control in a form of intermittently injecting the removing gas through the injection hole.

8. The vacuum pump according to claim 1, wherein
the control of the flowrate includes at least either one of control in a form of keeping the flowrate of the removing gas injected through the injection hole constant and control in a form of increasing or reducing the flowrate.

9. The vacuum pump according to claim 1, wherein
the removing gas is an inert gas.

10. The vacuum pump according to claim 1, wherein the removing gas is a high-energy gas activated by exciting means.

11. The vacuum pump according to claim 1, the removing means further comprising a plurality of injection holes, wherein the injection hole is one of the plurality of injection holes.

12. The vacuum pump according to claim 1, wherein
the inner wall surface of the flow path is formed of a porous material and holes of the porous material are adopted as the injection hole.

13. The vacuum pump according to claim 12, wherein,
by masking a part of a surface of the porous material constituting the inner wall surface of the flow path and configuring a portion other than the part of the surface as a non-masked portion that is not masked, the removing gas is injectable into the flow path through the holes of the porous material within a range of the non-masked portion.

14. The vacuum pump according to claim 12, wherein
a plate body having a surface area larger than an opening area of an opening end of the injection hole is provided near the opening end, and
the plate body is formed of a porous material and holes of the porous material are adopted as the injection hole.

15. The vacuum pump according to claim 1, wherein
the flow path is a thread groove-shaped flow path formed between an outer periphery of the rotating body and a stator member opposed to the outer periphery and
one end of the injection hole is opened at a portion of the inner wall surface of the flow path near a downstream exit of the flow path.

16. The vacuum pump according to claim 1, wherein
the flow path is a thread groove-shaped flow path formed between an outer periphery of the rotating body and a stator member opposed to the outer periphery and
one end of the injection hole is opened at a portion of the inner wall surface of the flow path near an upstream entrance of the flow path.

17. The vacuum pump according to claim 1, wherein
the flow path includes a clearance set between a rotor blade provided on an outer peripheral surface of the rotating body and a stator blade positioned and fixed in the casing and
one end of the injection hole is opened at a portion of the inner wall surface of the flow path near a downstream exit of the flow path.

18. The vacuum pump according to claim 1, wherein
the flow path includes a discharge port communicating with a downstream exit of the flow path and
one end of the injection hole is opened at the inner wall surface of the discharge port.

19. The vacuum pump according to claim 1, wherein
the flow path includes a clearance set between a rotor blade provided on an outer peripheral surface of the rotating body and a stator blade positioned and fixed in the casing and
the flow path includes an inner surface of a spacer that positions and fixes the stator blade and one end of the injection hole is opened in an inner wall surface of the spacer.

20. The vacuum pump according to claim 1, wherein
the flow path includes a clearance set between a rotor blade provided on an outer peripheral surface of the rotating body and a stator blade positioned and fixed in the casing and
one end of the injection hole is opened in an outer surface of the stator blade.

21. The vacuum pump according to claim 1, wherein
the inner wall surface of the flow path is coated with a material having higher non-adhesiveness or lower surface free energy than a structural base material of the flow path.

22. The vacuum pump according to claim 21, wherein
the material with which the inner wall surface is coated is a fluororesin or a coating material including a fluororesin.

23. A stator component of a vacuum pump, the stator component comprising:
a flow path through which a gas is transferred from a vacuum pump inlet port toward a vacuum pump outlet port; and
removing means configured to remove a product deposited on an inner wall surface of the flow path, wherein the removing means has an injection hole with one end opened at the inner wall surface of the flow path and removing gas is injected into the flow path through the injection hole,
control means configured to function as means for performing control of any of pressure, a flowrate, and an injection time of the removing gas, and
the control of the pressure includes at least either one of control in a form of keeping the pressure of the removing gas injected through the injection hole constant and control in a form of supplying, to the injection hole in a projecting manner, the removing gas injected through the injection hole.

24. A discharge port of a vacuum pump, the discharge port comprising:
a flow path through which a gas is transferred from a vacuum pump inlet port toward a vacuum pump outlet port; and
removing means configured to remove a product deposited on an inner wall surface of the flow path,
wherein the removing means has an injection hole with one end opened at the inner wall surface of the flow path and removing gas is injected into the flow path through the injection hole,
control means configured to function as means for performing control of any of pressure, a flowrate, and an injection time of the removing gas, and
the control of the pressure includes at least either one of control in a form of keeping the pressure of the removing gas injected through the injection hole constant and control in a form of supplying, to the injection hole in a projecting manner, the removing gas injected through the injection hole.

25. Control means for a removing gas of a vacuum pump comprising:

a flow path through which a gas is transferred from a vacuum pump inlet port toward a vacuum pump outlet port; and removing means configured to remove a product deposited on an inner wall surface of the flow path, the removing means having an injection hole with one end opened at the inner wall surface of the flow path and injecting the removing gas into the flow path through the injection hole, wherein the control means is configured to control any of pressure, a flowrate, and an injection time of the removing gas, the control of the pressure includes at least either one of control in a form of keeping the pressure of the removing gas injected through the injection hole constant and control in a form of supplying, to the injection hole in a projecting manner, the removing gas injected through the injection hole, and the control means outputs a signal required to adjust a supply pressure or a supply flowrate of the removing gas, functions as means for outputting a signal required to sound an alert, or functions as means for supplying the removing gas to the injection hole based on an instruction from an external device.

* * * * *